US012747082B2

(12) United States Patent
Wang

(10) Patent No.: US 12,747,082 B2
(45) Date of Patent: Sep. 29, 2026

(54) PRESSURE RELIEF CONTAINER FOR FOOD TO BE HEATED AND BOX HAVING SAID CONTAINER

(71) Applicant: SOUTH PLASTIC INDUSTRY CO., LTD., New Taipei City (TW)

(72) Inventor: Tong-Chang Wang, New Taipei City (TW)

(73) Assignee: SOUTH PLASTIC INDUSTRY CO., LTD., New Taipei City (TW)

( * ) Notice: Subject to any disclaimer, the term of this patent is extended or adjusted under 35 U.S.C. 154(b) by 144 days.

(21) Appl. No.: 18/652,567

(22) Filed: May 1, 2024

(65) Prior Publication Data

US 2024/0425259 A1 Dec. 26, 2024

(30) Foreign Application Priority Data

Jun. 21, 2023 (TW) ..... 112123530
Feb. 7, 2024 (TW) ..... 113105092

(51) Int. Cl.
*B65D 77/22* (2006.01)
*B65D 81/34* (2006.01)

(52) U.S. Cl.
CPC ..... *B65D 77/225* (2013.01); *B65D 81/3453* (2013.01); *B65D 2205/025* (2013.01); *B65D 2581/3455* (2013.01)

(58) Field of Classification Search
CPC ..... B65D 2205/00; B65D 77/225; B65D 2581/34; B65D 77/2024; B65D 81/3446; B65D 81/3453; B65D 2205/025; B65D 2581/3455
See application file for complete search history.

(56) References Cited

U.S. PATENT DOCUMENTS

| | | | | |
|---|---|---|---|---|
| 4,834,247 | A * | 5/1989 | Oshima | B65D 77/225 220/360 |
| 9,938,056 | B2 * | 4/2018 | Inaba | B65D 51/1666 |
| 10,233,009 | B2 * | 3/2019 | Ishikawa | B65D 77/2036 |
| 11,447,324 | B2 * | 9/2022 | Ishikawa | B65D 77/2052 |
| 2020/0115120 | A1 * | 4/2020 | Kim | B65D 51/1638 |

* cited by examiner

*Primary Examiner* — Shawn M Braden
(74) *Attorney, Agent, or Firm* — RABIN & BERDO, P.C.

(57) ABSTRACT

A container for food to be heated includes a bottom surface, a sidewall, a peripheral portion, and a pressure relief protrusion. The peripheral portion includes a peripheral plane, an inner edge, an outer edge, and a pressure relief region. The pressure relief region is on the peripheral plane. The pressure relief protrusion is in the pressure relief region, and the pressure relief protrusion contacts the inner edge. The pressure relief protrusion includes a pressure relief curved surface, and the pressure relief curved surface is connected to the peripheral plane. When the peripheral plane contacts a sealing film, the pressure relief curved surface also contacts the sealing film and forms a gap between the sealing film and the junction between the pressure relief curved surface and the peripheral plane. A box having the container is also provided.

15 Claims, 22 Drawing Sheets

(1)

(2)

(1)

(2)

(3)

(1)

(2)

(1)

(2)

PRESSURE RELIEF CONTAINER FOR FOOD TO BE HEATED AND BOX HAVING SAID CONTAINER

CROSS-REFERENCES TO RELATED APPLICATIONS

This non-provisional application claims priority under 35 U.S.C. § 119(a) to Patent Application No. 112123530 filed in Taiwan, R.O.C. on Jun. 21, 2023 and Patent Application No. 113105092 filed in Taiwan, R.O.C. on Feb. 7, 2024, the entire contents of which are hereby incorporated by reference.

BACKGROUND

Technical Field

The present disclosure relates to a container for food to be heated, particularly to a container for microwave food. Furthermore, the present disclosure also relates to a box having the aforementioned container.

Related Art

To cater to the needs of people with a modern lifestyle which emphasizes convenience and speed, most convenience stores provide refrigerated/frozen meal boxes with packaged food. These meal boxes, when needed, can be quickly heated through methods such as microwaving, such that people can enjoy hot meals in a short time.

For these types of meal boxes, a sealing film is usually used to be placed on a container to isolate the food inside from the ambient environment, reducing exposure of the food to external factors and thus preserving the food inside.

SUMMARY

However, these meal boxes need to be heated. When the meal box is heated, the moisture in the food inside the container will be converted into steam, thereby increasing the pressure inside the box. Generally speaking, to prevent excessive pressure build-up inside the box during heating, it is necessary to at least partially tear open the sealing film or cut an opening in the sealing film with a sharp object before subjecting the meal box to a heating procedure such as microwaving. However, if the sealing film is not intentionally opened or cut for convenience, or if the sealing film is simply forgotten to be opened or cut in advance, there is a potential risk of the food inside the meal box bursting from the sides. This could result in the food inside splashing onto surfaces such as the interior wall of the microwave oven. In addition to causing food loss and subsequent cleaning issues, if such bursting occurs when the box is held by a person, it may further raise safety issues.

In order to solve the aforementioned problem(s), a general embodiment of the present disclosure provides a container that still has a pressure relief structure under the sealed state so as to address the aforementioned issue(s). More specifically, the present disclosure provides a container for food to be heated, which includes a bottom surface, a side wall, a peripheral portion, and a pressure relief protrusion. The side wall is connected to the bottom surface, and the side wall and the bottom surface together form an accommodation space in communication with the outside of the container. The peripheral portion is connected to the side wall and surrounds the accommodation space. The peripheral portion includes a peripheral plane, an inner edge, an outer edge, and a pressure relief region. The inner edge and the outer edge are connected to the peripheral plane, respectively. The inner edge is on the side of the peripheral plane nearer the accommodation space, the outer edge is on the side of the peripheral plane farther from the accommodation space. The pressure relief region is on the peripheral plane. The pressure relief protrusion is in the pressure relief region, and the pressure relief protrusion is in contact with the inner edge. The pressure relief protrusion includes a pressure relief curved surface, and the pressure relief curved surface is connected to the peripheral plane. When the peripheral plane is in contact with a sealing film and thus closes the accommodation space, the pressure relief curved surface is also in contact with the sealing film, and a gap is formed between the sealing film and a junction between the pressure relief curved surface and the peripheral plane.

Accordingly, a container having a pressure relief protrusion protruding outward from the peripheral plane, wherein the peripheral plane is configured to be in contact with a sealing film, is provided. The pressure relief protrusion has a pressure relief curved surface also configured to be in contact with the sealing film. It should be noted that, comparing to the attachment between the sealing film and the peripheral plane (which is flat), the attachment between the sealing film and the curved surface is relatively poorer. Thus, when the sealing film is attached to the container, a pseudo-adhesive region (a region with relatively weak adhesion of the sealing film) will be formed on and/or around the pressure relief protrusion, especially a gap will be formed between the sealing film and the junction between the pressure relief curved surface and the peripheral plane.

In addition, the present disclosure provides a container for food to be heated, including a bottom surface, a sidewall, a peripheral portion, a convex strip, and a groove. The side wall is connected to the bottom surface, and the side wall and the bottom surface together form an accommodation space in communication with the outside of the container. The peripheral portion is connected to the side wall and surrounds the accommodation space. The peripheral portion includes a peripheral plane, an inner edge, and an outer edge. The inner edge and the outer edge are connected to the peripheral plane, respectively. The inner edge is on the side of the peripheral plane nearer the accommodation space, the outer edge is on the side of the peripheral plane farther from the accommodation space. The convex strip protrudes from the peripheral plane, and an extension direction of the convex strip is parallel to an extension direction of the peripheral plane. The convex strip has a top surface parallel to the peripheral plane. The groove is located on the peripheral plane, the groove is in contact with the inner edge or the outer edge, and the groove at least partially overlaps the convex strip.

When the container and the sealing film are attached, there are convex strips on the peripheral plane, which can reduce the adhesion effect between the sealing film and the peripheral plane. In addition, since the peripheral portion is provided with a groove that overlaps the convex strip, the groove further reduces the area of the top surface of the convex strip, so that the groove may further reduce the adhesion effect between the sealing film and the convex strip, thereby forming a pseudo-adhesive region in this region with the groove.

Besides the poorer attachment of the sealing film in the pseudo-adhesive area, another factor that facilitates the steam relief is that the pressure relief protrusion is in contact with the inner edge of the peripheral portion and thus the pseudo-adhesive area is nearer the accommodation space of the container. Accordingly, when the steam generated in the accommodation space presses the sealing film, the steam can enter this structurally weak region and push open the sealing film. Thus, when the steam generated by heating increases the pressure inside the sealed container, the steam can be more easily discharged through the pseudo-adhesive region formed between the pressure relief protrusion and the sealing film. Therefore, the container has a pressure relief function even when it is sealed.

Furthermore, the present application also provides a box, which includes the aforementioned container and a sealing film. The sealing film is attached to the peripheral plane and the pressure relief curved surface of the at least one pressure relief protrusion or attached to the peripheral plane or the top surface, thereby sealing, for example, food in the accommodation space of the container.

The detailed features and advantages of the present application will be described in detail in the following embodiments. Those of ordinary skill in the art of the application can understand the technical content of the present application and implement it accordingly.

DETAILED DESCRIPTION

Hereinafter, the present application will be described more specifically with reference to the following embodiments. However, the embodiments are only used as examples for illustration, and are not used to limit the scope of the invention. The same reference number in each figure will be used to represent the same or similar component.

In the present application, the singular forms "a", "an" and "the" are intended to include the plural forms as well, unless the context clearly indicates otherwise. It can be further understood that the terms "include", "have" and other similar terms used in the present application mean to specify the features, regions, integers, steps, operations, components and/or assemblies in an element, but do not exclude one or more of the described or additional features, regions, integers, steps, operations, components, assemblies, and/or combination thereof, from the element.

Embodiments of Group 1

Figure 1:
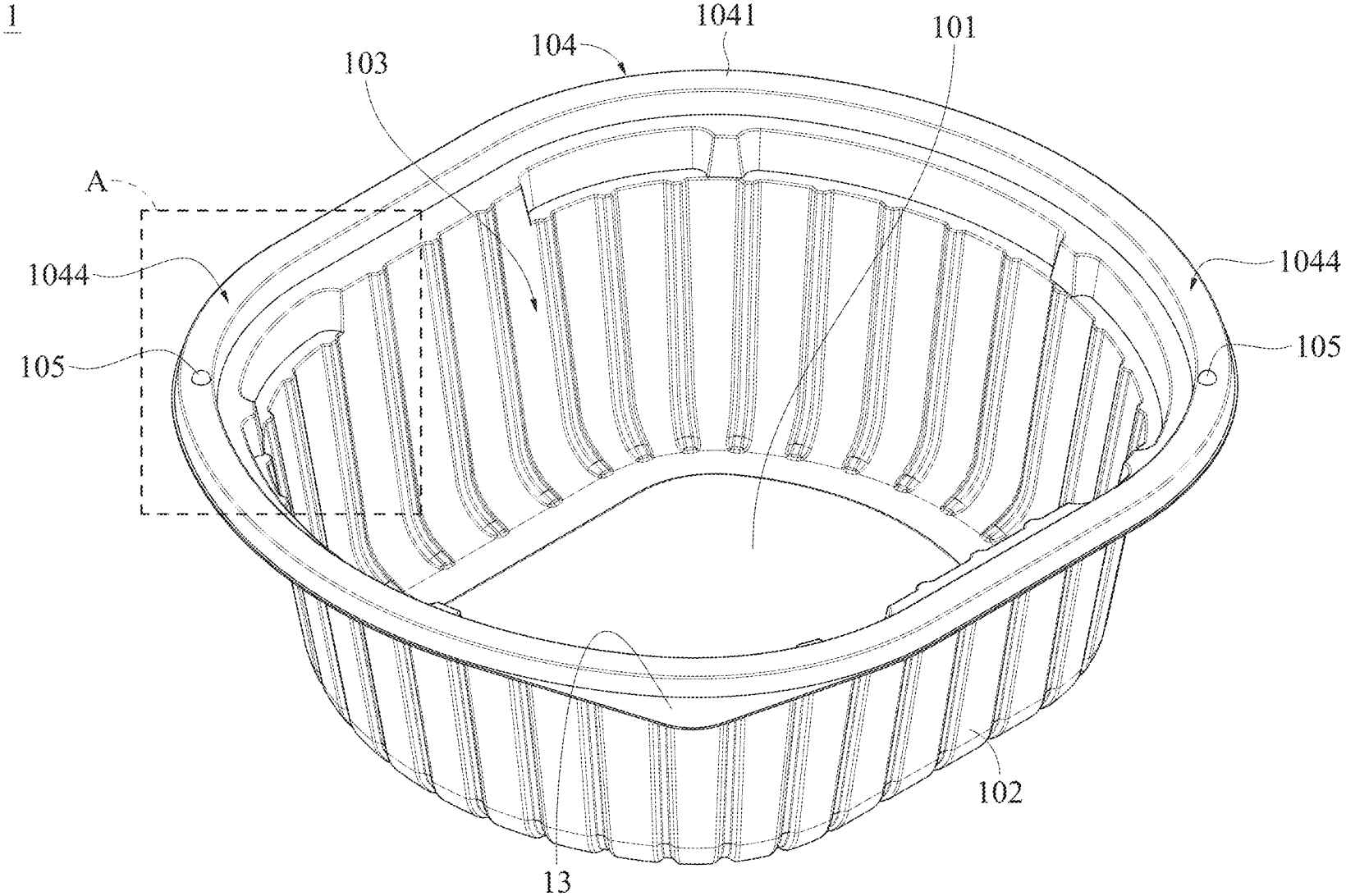
FIG. 1 illustrates a perspective view of a container according to an embodiment of the present application.

Please refer to FIG. 1. FIG. 1 illustrates a perspective view of a container 1 according to an embodiment of the present application. In this embodiment, the container 1 for food to be heated includes a bottom surface 101, a side wall 102 connected to the bottom surface 101, and a peripheral portion 104 connected to the side wall 102. The side wall 102 and the bottom surface 101 together form an accommodation space 103 for accommodating items such as food, and the peripheral portion 104 surrounds the accommodation space 103. The container 1 has an opening on the side opposite to the bottom surface 101. When the container 1 is not sealed with a sealing film, the accommodation space 103 is in communication with the outside of the container 1 through the opening. The peripheral portion 104 has a peripheral plane 1041 configured to be in contact with the sealing film when the container 1 is sealed. In some embodiments, since the peripheral portion 104 is mainly to provide the peripheral plane 1041, the peripheral portion 104 can completely surround the accommodation space 103 or discontinuously (i.e., partially) surround the accommodation space 103, as long as the peripheral portion 104 provides the peripheral plane 1041. In the embodiment shown in FIG. 1, the peripheral portion 104 completely surrounds the accommodation space 103. Since the peripheral portion 104 has a greater peripheral plane 1041 in such arrangement, a better attachment between the container 1 and the sealing film can be provided.

Although the container 1 in FIG. 1 is roughly a rounded rectangle when viewed from the top of the container 1, the shape of the container 1 is not limited in the present application. Depending on actual demands, the container 1 can be made to roughly present a circle, a rectangle, or other polygons when viewed from the top of the container 1. Moreover, in the embodiment shown in FIG. 1, although the area of the bottom surface 101 of the container 1 is approximately equal to the area of the opening of the accommodation space 103, the area of the bottom surface 101 may also be less or greater than the area of the opening of the accommodation space 103, depending on actual implementation demands.

Figure 2:
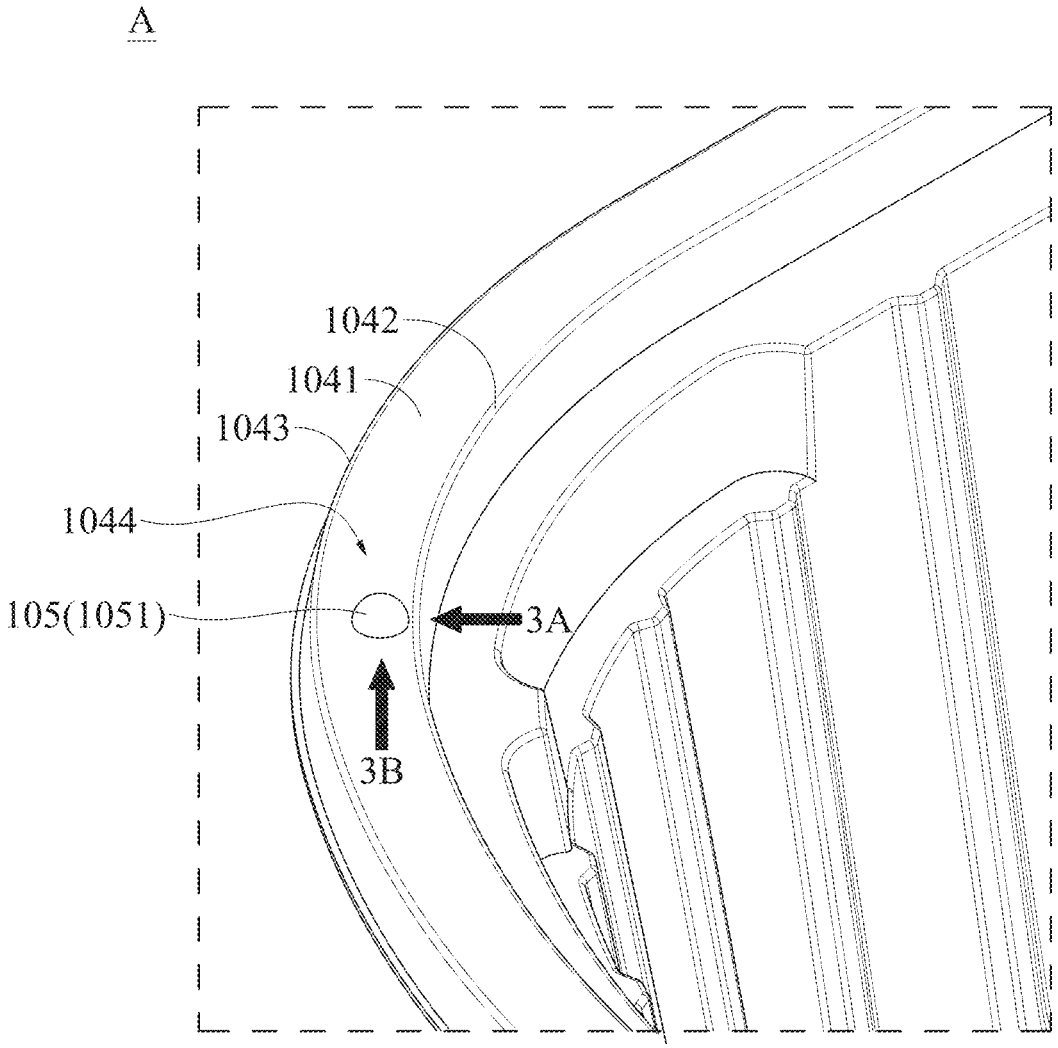
FIG. 2 illustrates an enlarged partial view of the container of FIG. 1.

Please continue to refer to FIG. 1 and also refer to FIG. 2. FIG. 2 illustrates an enlarged partial (that is, a dotted box A in FIG. 1) view of the container 1 in FIG. 1. In this embodiment, the peripheral plane 1041 of the peripheral portion 104 has an inner edge 1042 adjacent to the accommodation space 103 and an outer edge 1043 away from the accommodation space 103. The peripheral plane 1041 has a pressure relief protrusion 105 that protrudes from the peripheral plane 1041 and extends away from the bottom surface 101. The pressure relief protrusion 105 is in contact with the inner edge 1042 of the peripheral portion 104. Moreover, the pressure relief protrusion 105 has a pressure relief curved surface 1051 configured to be in contact with the sealing film, and the pressure relief curved surface 1051 is connected to the peripheral plane 1041.

Figure 3A:
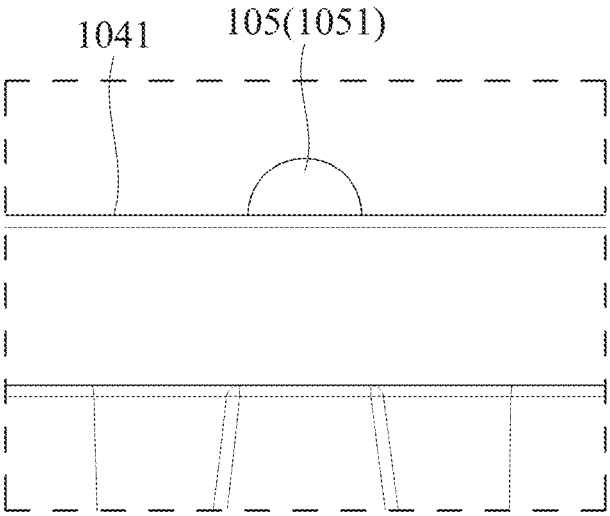
FIG. 3A illustrates a side view of the pressure relief protrusion when viewed from the accommodation space in FIG. 2 (i.e., viewed along the direction of arrow 3A in FIG. 2).
Figure 3B:
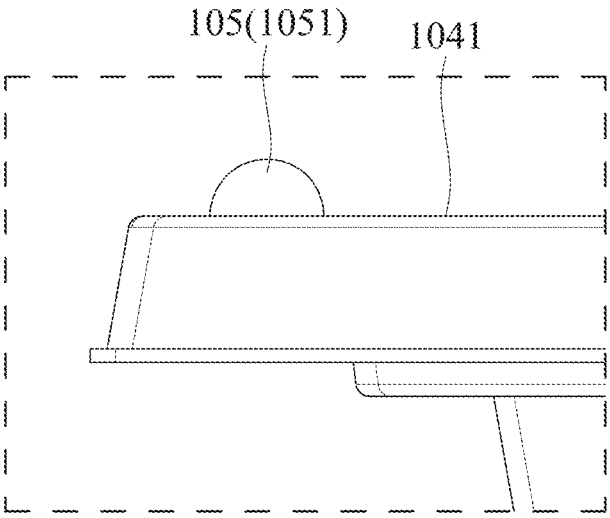
FIG. 3B illustrates a side view of the pressure relief protrusion when viewed along the extension direction of the peripheral plane in FIG. 2 (i.e., viewed along the direction of arrow 3B in FIG. 2).
Figure 4:
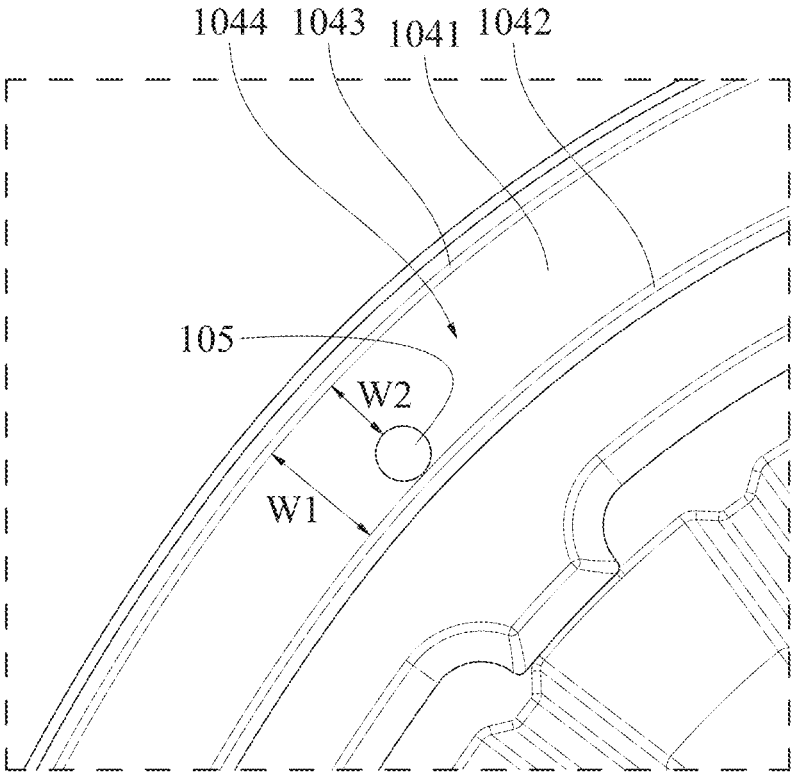
FIG. 4 illustrates an enlarged partial top view of the container in FIG. 2.

To further illustrate the shape of the pressure relief protrusion 105 in this embodiment, please refer to FIG. 3A, FIG. 3B and FIG. 4. FIG. 3A illustrates a side view of the pressure relief protrusion 105 viewed from the accommodation space 103 towards the pressure relief protrusion 105 in FIG. 2; FIG. 3B illustrates a side view of the pressure relief protrusion 105 viewed along the extension direction 1041*a* of the peripheral plane 1041 in FIG. 2; FIG. 4 illustrates an enlarged partial top view of the container 1 in FIG. 2. In this embodiment, as shown in FIG. 3A and FIG. 3B, the pressure relief protrusion 105 is a hemisphere protruding from the peripheral plane 1041 and has a curved surface connected to the peripheral plane 1041. Furthermore, as shown in FIG. 4, the pressure relief protrusion 105 is in contact with the inner edge 1042 of the peripheral portion 104.

Please still refer to FIG. 3A and FIG. 3B. In some embodiments, as shown in FIG. 3A, when viewed from the accommodation space 103 towards the pressure relief protrusion 105, the shape of the pressure relief protrusion 105 can also be regarded as that both the left profile and the right profile of the pressure relief protrusion 105 at least partially have an outwardly convex curve connected to the peripheral plane 1041, wherein the left profile of the pressure relief protrusion 105 is defined from the highest point of the pressure relief protrusion 105 to the farthest left end of the pressure relief protrusion 105, and the right profile of the pressure relief protrusion 105 is defined from the highest point of the pressure relief protrusion 105 to the farthest right end of the pressure relief protrusion 105. On the other hand, when the pressure relief protrusion 105 is viewed from the side along the extension direction 1041*a* of the peripheral plane 1041, then as shown in FIG. 3B, the profile defined from the highest point of the pressure relief protrusion 105 to the lowest point of the pressure relief protrusion 105 along the direction toward the outer edge 1043 also at least partially has an outwardly convex curve connected to the peripheral plane 1041.

Please still refer to FIG. 2, FIG. 3A, and FIG. 3B. In some embodiments, when container 1 is to be sealed to close the accommodation space 103, a plastic sealing film can be heat-pressed from top onto the peripheral plane 1041 of the peripheral portion 104 of container 1 by using such as a sealing machine. Since the pressure relief protrusion 105 protrudes from the peripheral plane 1041 and extends away the bottom surface 101, the sealing film will also be in contact with the pressure relief curved surface 1051 of the pressure relief protrusion 105 during the sealing process. However, the adhesion between the sealing film and the curved surface is relatively weaker compared to the adhesion between the sealing film and the peripheral plane 1041, and also the sealing film cannot be easily attached to the junction between the pressure relief curved surface 1051 and the peripheral plane 1041. Thus, when the container 1 is to be sealed to close the accommodation space 103, the sealing film will generate a pseudo-adhesive region (i.e., a region with relatively weaker adhesion of the sealing film) on and/or around the pressure relief protrusion 105.

Besides the relatively weaker adhesion of the sealing film at the pseudo-adhesion region (which causes, for example, a gap to be formed at the junction between the pressure relief surface 1051 and the peripheral plane 1041), another factor that facilitates the steam relief is that the pressure relief protrusion 105 is in contact with the inner edge 1042 of the peripheral portion 104 so that the pressure relief protrusion 105 is nearer the accommodation space 103 of the container 1. Therefore, when the steam generated inside the accommodation space 103 by heating presses the sealing film, the steam can enter this structurally weaker region and push open the sealing film at this location. In other words, in some embodiments, a pressure relief path will be formed around the pressure relief protrusion 105. Consequently, when the steam generated by heating causes an increase of the internal pressure of the sealed container 1, the steam can move toward the outside of the container 1 through the pseudo-adhesion region formed between the pressure relief protrusion 105 and the sealing film, and thus the steam can be discharged out more easily. Hence, the container 1 would still have a pressure relief function even when the container 1 is sealed.

It is worth mentioning that, due to factors such as manufacturing tolerances, the expression "the pressure relief protrusion 105 is in contact with the inner edge 1042 of the peripheral portion 104" includes situations where the pressure relief protrusion 105 is not precisely in contact with the inner edge 1042, but a gap (e.g., about 0.1 mm or 0.2 mm) is between the pressure relief protrusion 105 and the inner edge 1042, and the gap is sufficiently small not to obstruct the steam inside the container 1 to enter the pressure relief path.

Figure 5:
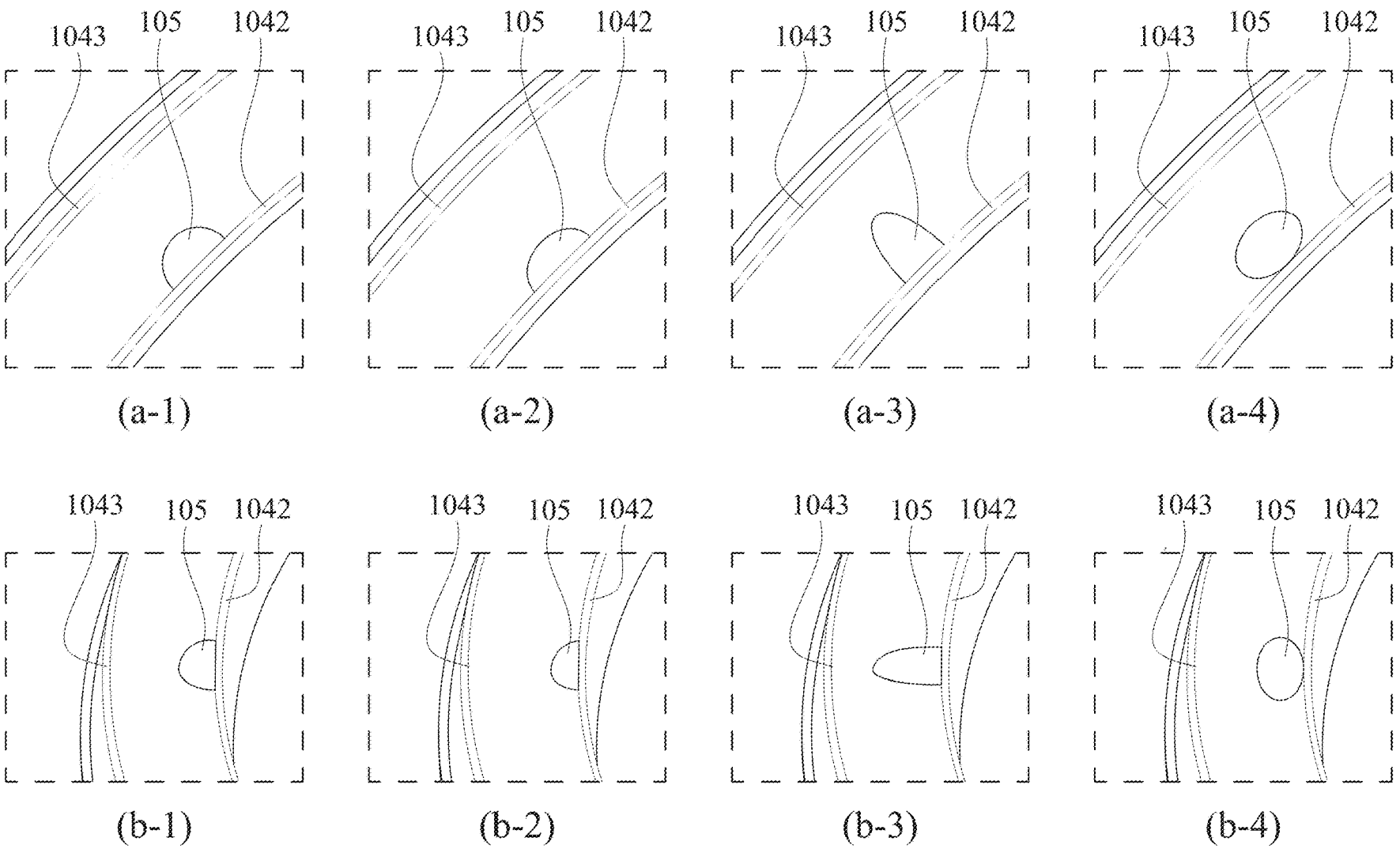
FIG. 5: (a-1) to (a-4) illustrate enlarged partial top views of containers according to multiple embodiments; (b-1) to (b-4) illustrate partial enlarged perspective views of the corresponding containers.

In the aforementioned embodiments, the shape of a projection of the pressure relief protrusion 105 onto the peripheral plane 1041 is circular. However, as long as the pressure relief protrusion 105 is in contact with the inner edge 1042 of the peripheral portion 104 and has a pressure relief curved surface 1051 configured to be in contact with the sealing film, the shape of the projection of the pressure relief protrusion 105 onto the peripheral plane 1041 is not limited. For example, please refer to FIG. 5. The sub-figures in the top row of FIG. 5 (i.e., FIG. 5-(*a*-1) to FIG. 5-(*a*-4)) illustrate enlarged partial top views of the container 1 in different embodiments, while the sub-figures in the bottom row of FIG. 5 (i.e., FIG. 5-(*b*-1) to FIG. 5-(*b*-4)) illustrate enlarged partial perspective views of the containers 1 corresponding to the figures mentioned above, which are provided to assist in understanding the three-dimensional shapes of the pressure relief protrusions 105 in FIG. 5-(*a*-1) to FIG. 5-(*a*-4), respectively. As shown in FIG. 5-(*a*-1) to FIG. 5-(*a*-4) in FIG. 5, the shape of the projection of the pressure relief protrusion 105 onto the peripheral plane 1041 may also be semi-circular (as shown in FIG. 5-(*a*-1)), semi-elliptical (as shown in FIG. 5-(*a*-2), FIG. 5-(*a*-3)), or elliptical (as shown in FIG. 5-(*a*-4)).

Please refer back to FIG. 1. On the other hand, since the pressure relief protrusion 105 can help the container 1 to release pressure, the region on the peripheral plane 1041 with the pressure relief protrusion 105 (which is a pressure relief structure), can be regarded as a pressure relief region 1044. In other words, in some embodiments, the pressure relief region 1044 is a user-defined area for convenience in describing the structure of the container 1 in the subsequent paragraphs. The pressure relief region 1044 may be of any size on the peripheral plane 1041, as long as the region contains the pressure relief protrusion 105. Depending on the demands, one or more pressure relief regions 1044 may be configured/defined on the peripheral plane 1041. For example, as shown in FIG. 1, in this embodiment, it can be considered that two pressure relief regions 1044 are on the peripheral plane 1041, and the two pressure relief regions 1044 are respectively on the peripheral plane 1041 at the diagonal positions of the container 1. It should be noted that, although the structures of the two pressure relief regions 1044 are identical in this embodiment, since the pressure relief structure provided by the present application may have various forms, the structures among the multiple pressure relief regions 1044 on the peripheral plane 1041 of the present application may also be different from each other.

Furthermore, the pressure relief region 1044 may also be positioned at anywhere on the peripheral plane 1041. However, in some embodiments, as shown in FIG. 1, the pressure relief region 1044 may be offset from a grip portion 13, wherein the grip portion 13 is preset on the container 1 for the user to grasp so as to assist in the removal of the sealing film. For example, the pressure relief protrusion 105 may be positioned on the peripheral plane 1041 where the outer side of the peripheral plane 1041 does not have a grip portion 13. Under such arrangement, the user's hand can be prevented from encountering steam released through the pressure relief region 1044, thus reducing the chance of impeding the user or the risk of user burns.

The details or other embodiments of the pressure relief protrusion 105, which can be regarded as a pressure relief structure in the pressure relief region 1044, will be further illustrated below.

Figure 6:
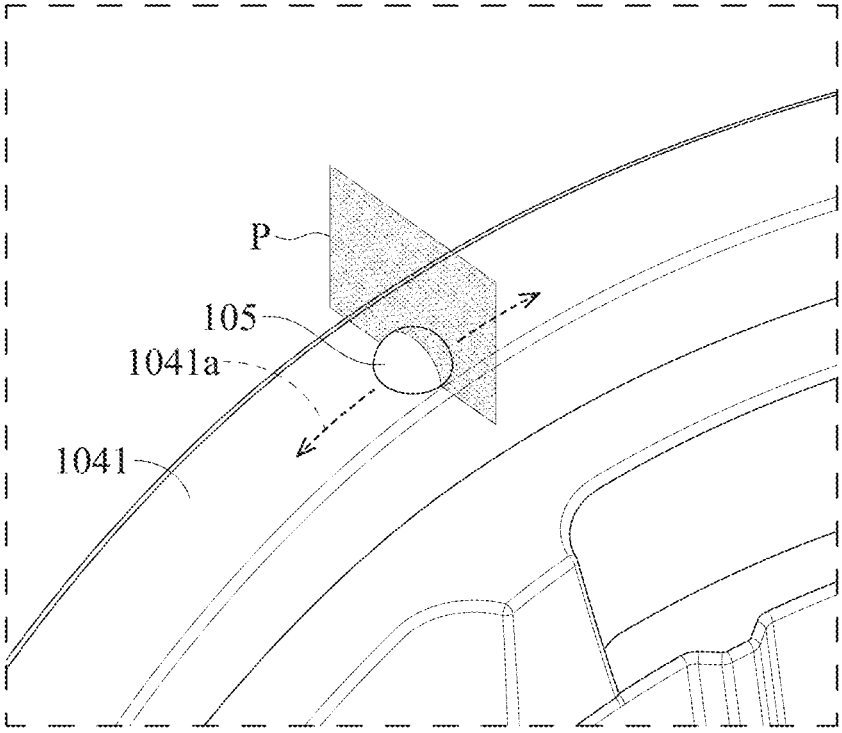
FIG. 6 illustrates an enlarged partial perspective view of the container of FIG. 1.

Please still refer to FIG. 2 and also refer to FIG. 6. FIG. 6, like FIG. 2, also illustrates an enlarged partial view of the container 1 in FIG. 1 and can also be regarded as a perspective view of the pressure relief protrusion 105. In this embodiment, the pressure relief protrusion 105 is of a bilateral symmetry. That is, in this embodiment, the pressure relief protrusion 105 has a symmetry plane P, which is perpendicular to the peripheral plane 1041 and the extension direction 1041*a* of the peripheral plane 1041. Therefore, by making the pressure relief protrusion 105 be of a bilateral symmetry, the pseudo-adhesion region (or pressure relief path) formed by the sealing film around the pressure relief protrusion 105 can also be approximately of a bilateral symmetry. This arrangement allows the left side and the right side of the pressure relief protrusion 105 to have similar pressure relief rates, thereby minimizing the risk of uneven expansion on either side of the pressure relief protrusion 105 when the container 1 is sealed.

Figure 7:
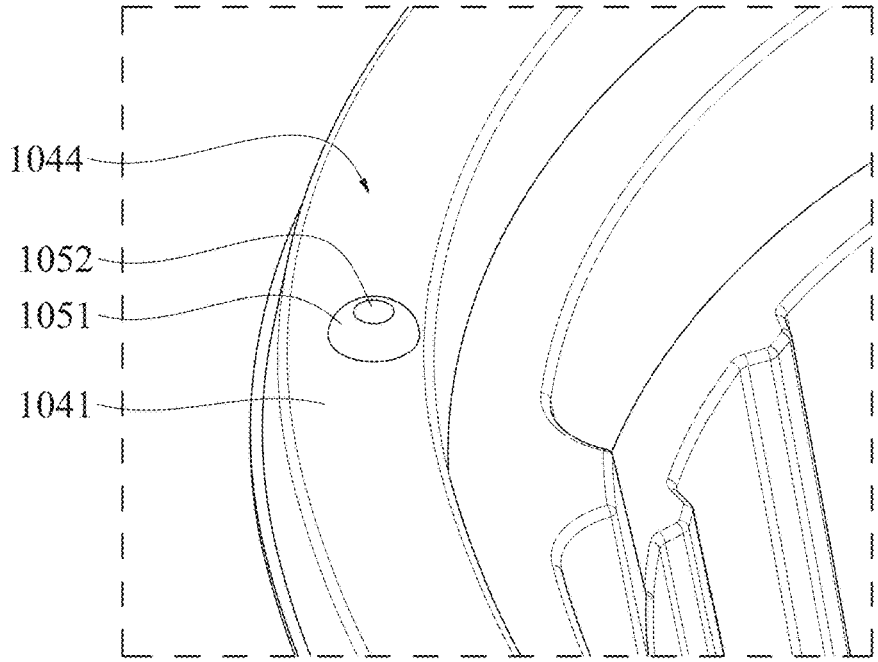
FIG. 7 illustrates an enlarged partial perspective view of a container according to another embodiment of the present application.

Please refer to FIG. 7, which illustrates an enlarged partial perspective view of a container 1 according to another embodiment of the present application. In the previous embodiment as shown in FIG. 2, the pressure relief protrusion 105 is a hemisphere, and thus there is only a vertex on the top of the pressure relief protrusion 105. However, in some embodiments, as shown in FIG. 7, where the pressure relief protrusion 105 has a top surface 1052 positioned at the farthest distance from the peripheral plane 1041, and the top surface 1052 is parallel to the peripheral plane 1041. Therefore, according to some embodiments, through the arrangement of the top surface 1052 above the pressure relief protrusion 105 and parallel to the peripheral plane 1041, the adhesion between the sealing film and the pressure relief protrusion 105 can be increased, thereby allowing an adjustment to the adhesiveness between the sealing film and the pressure relief protrusion 105 when needed.

Please refer back to FIG. 4. In the aforementioned embodiment, the pressure relief protrusion 105 is only in contact with the inner edge 1042 of the peripheral plane 1041 but not in contact with the outer edge 1043 of the peripheral plane 1041. Under such arrangement, a portion of the peripheral plane 1041 remains between the pressure relief protrusion 105 and the outer edge 1043 of the peripheral plane 1041. That is, in this embodiment, a flat portion is formed between the pressure relief protrusion 105 and the outer edge 1043, wherein the flat portion can generate better adhesion to the sealing film. Accordingly, when the container 1 is to be sealed with a sealing film, a certain level of adhesion between the pressure relief region 1044 and the sealing film can be maintained while the container 1 has a pressure relief structure, thereby preventing the sealing film from easily separating apart from the pressure relief region 1044. Therefore, the container 1 could be used to hold foods that require more tightness, such as water-rich foods, soup, and the like. In other embodiments, neither holes or concaves lower than the peripheral plane 1041 nor protrusions higher than the peripheral plane 1041 is at the portion of the peripheral plane 1041 between the pressure relief protrusion 105 and the outer edge 1043 of the peripheral plane 1041, such that a complete flat surface is formed between the pressure relief protrusion 105 and the outer edge 1043 of the peripheral plane 1041.

Please still refer to FIG. 4. In some embodiments, the peripheral plane 1041 has a width W1 at the pressure relief protrusion 105, and a shortest distance W2 is between the pressure relief protrusion 105 and the outer edge 1043 of the peripheral plane 1041, where the shortest distance W2 is equal to or less than half of the width W1 of the peripheral plane 1041. Accordingly, in some embodiments with such arrangement, since no excessive peripheral plane 1041 is left between the pressure relief protrusion 105 and the outer edge 1043, the sealing film will not adhere too tightly to the outer side of the pressure relief protrusion 105, thereby ensuring that the steam passing through the pressure relief path formed by the pressure relief protrusion 105 can be discharged out more smoothly.

Figure 8:
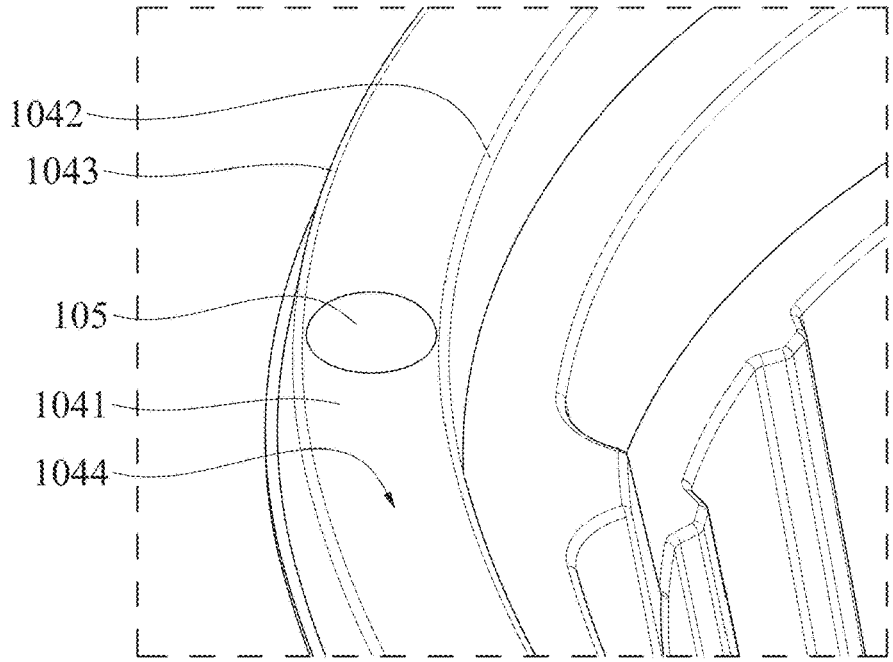
FIG. 8 illustrates an enlarged partial perspective view of a container according to another embodiment of the present application.

In some other embodiments, as shown in FIG. 8, the pressure relief protrusion 105 is not only in contact with the inner edge 1042 of the peripheral plane 1041 but also in contact with the outer edge 1043 of the peripheral plane 1041. Since there is almost no flat portion remaining between the pressure relief protrusion 105 and the outer edge 1043 of the peripheral plane 1041 under such arrangement, the adhesion between the pressure relief region 1044 and the sealing film will be minimized as much as possible under such arrangement. For example, under such arrangement, in the case where only foods with less soup are placed in the accommodation space 103 and thus high tightness is not necessarily needed, the sealing film can be more easily torn off at the portion of the pressure relief region 1044 where the pressure relief protrusion 105 is to avoid leaving sealing film residues left on the container 1.

Figure 9:
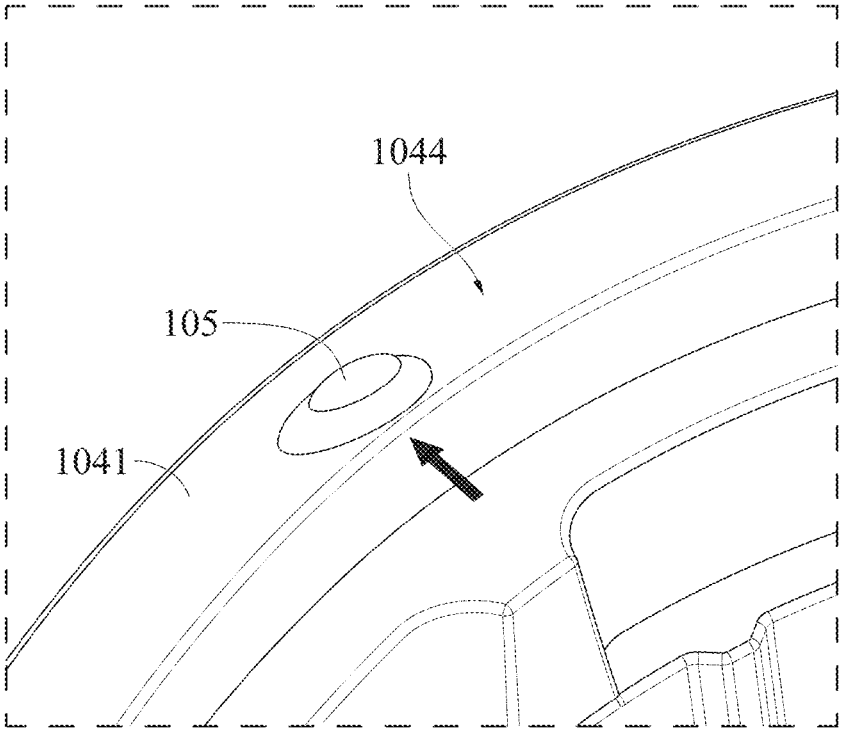
FIG. 9: (1) illustrates an enlarged partial perspective view of a container according to another embodiment of the present application, and (2) illustrates a side view of the pressure relief protrusion when viewed from the accommodation space in (1).
Figure 9:
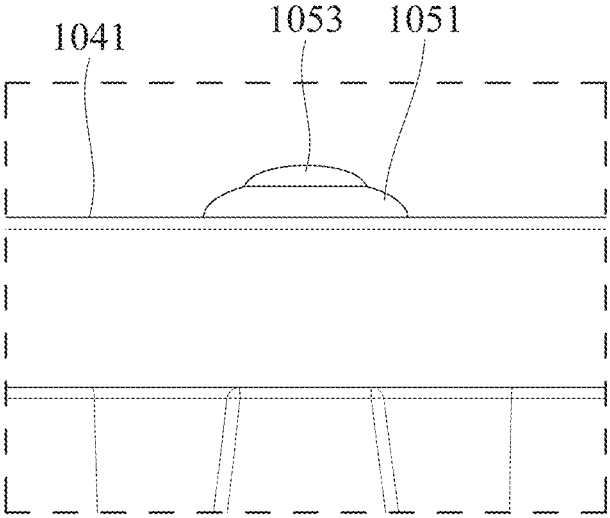

Next, please refer to FIG. 9, wherein FIG. 9-(1) illustrates an enlarged partial perspective view of a container 1 according to another embodiment of the present application, and FIG. 9-(2) illustrates a side view of the pressure relief protrusion 105 when viewed from the accommodation space 103 towards the pressure relief protrusion 105 in FIG. 9-(1). In some embodiments, in addition to the pressure relief curved surface 1051 that is connected to the peripheral plane 1041, the pressure relief protrusion 105 may also have other curved surface(s). For example, as shown in FIG. 9, in this embodiment, the pressure relief protrusion 105 not only has the pressure relief curved surface 1051 but also has an additional curved surface 1053 that is not connected to the peripheral plane 1041. The additional curved surface 1053 can be used to further reduce the adhesiveness between the sealing film and the pressure relief protrusion 105, thereby allowing an adjustment to obtain a desired attachment performance.

Figure 10:
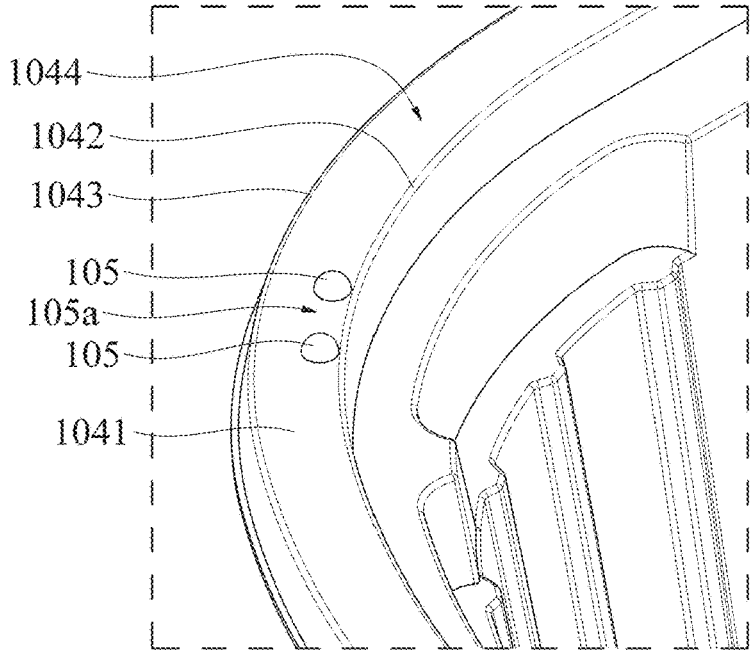
FIG. 10 illustrates an enlarged partial perspective view of a container according to another embodiment of the present application.

Next, please refer to FIG. 10, which illustrates an enlarged partial perspective view of a container 1 according to another embodiment of the present application. In some embodiments, multiple pressure relief protrusions 105 may be in the pressure relief region 1044. For example, as shown in FIG. 10, two adjacent pressure relief protrusions 105 may be in the pressure relief region 1044. It should be noted that the term "adjacent" here is used to indicate that no other pressure relief protrusions 105 are between two pressure relief protrusions 105 along the extension direction 1041*a* of the peripheral plane 1041. Since a space is between two adjacent pressure relief protrusions 105, and the steam will also pass through the space when passing through the pseudo-adhesive region formed between the pressure relief protrusions 105 and the sealing film, the space between the two adjacent pressure relief protrusions 105 can be regarded as a passage for the steam to pass through. In other words, in some embodiments, a pressure relief passage 105*a* is between the two pressure relief curved surfaces 1051 of the two pressure relief protrusions 105.

Figure 11:
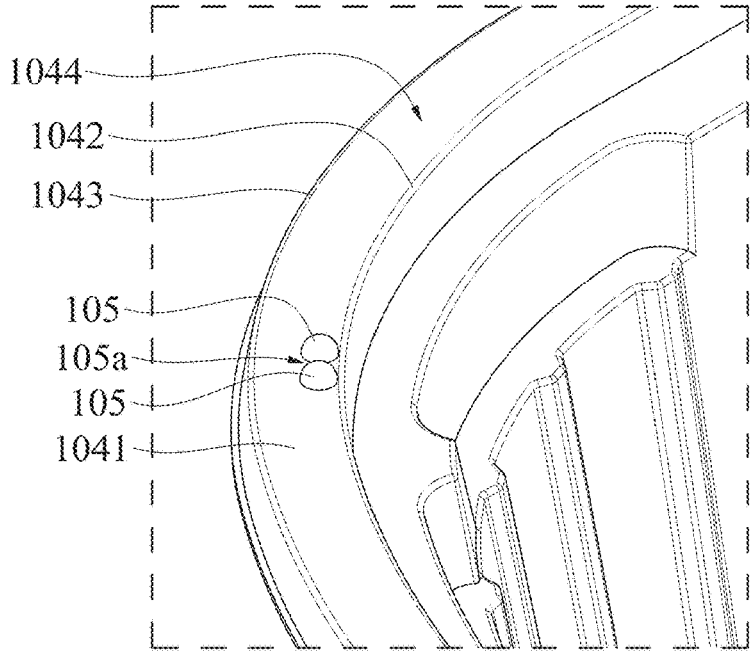
FIG. 11 illustrates an enlarged partial perspective view of a container according to another embodiment of the present application.

Furthermore, please refer to FIG. 11, which illustrates an enlarged partial perspective view of a container 1 according to another embodiment of the present application. In some embodiments, two adjacent pressure relief protrusions 105 are in contact with each other, and under such arrangement, the narrowest pressure relief passage 105*a* can be formed between the two adjacent pressure relief protrusions 105, so that the steam passing through the pressure relief passage 105*a* can be more concentrated. Thus, the discharge direction of the steam can be predicted more precisely, which is helpful for the design of the container 1. For example, it may be helpful to arrange the discharge direction of the steam away from the user's operation/holding area.

It should be noted that if multiple pressure relief protrusions 105 exist within the pressure relief region 1044, the structures of the pressure relief protrusion 105 may be different. For example, when multiple pressure relief protrusions 105 are in the pressure relief region 1044, the pressure relief protrusion 105 may have different heights (the term "height" here is to indicate the shortest distance between the peripheral plane 1041 and the highest point of the pressure relief protrusion 105), different shapes in the side view, and/or different shapes in the top view. However, if all the pressure relief protrusions 105 in the pressure relief region 1044 have the same structures, not only the manufacturing of the container 1 can be simplified but also a more accurate prediction of the discharge direction of the steam can be achieved.

Figure 12:
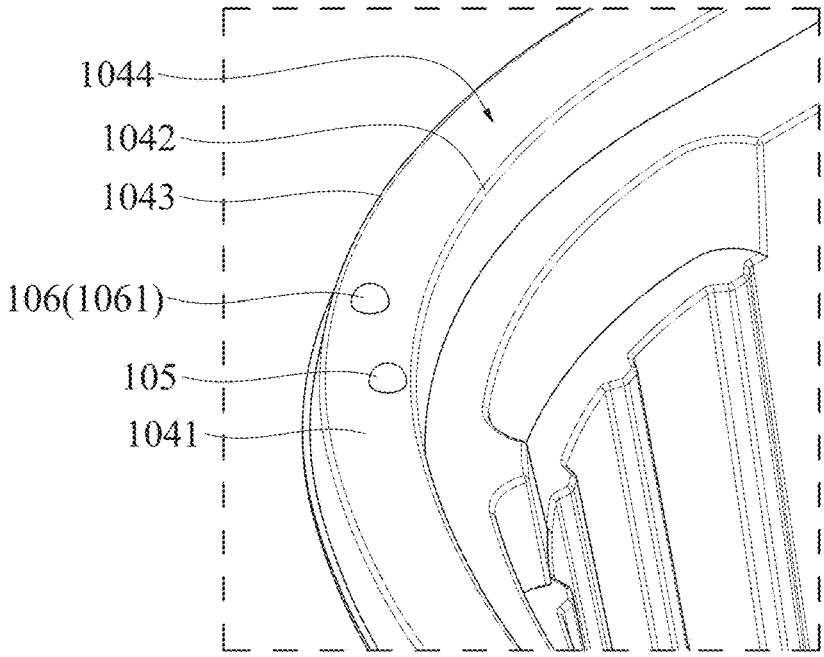
FIG. 12 illustrates an enlarged partial perspective view of a container according to another embodiment of the present application.
Figure 13:
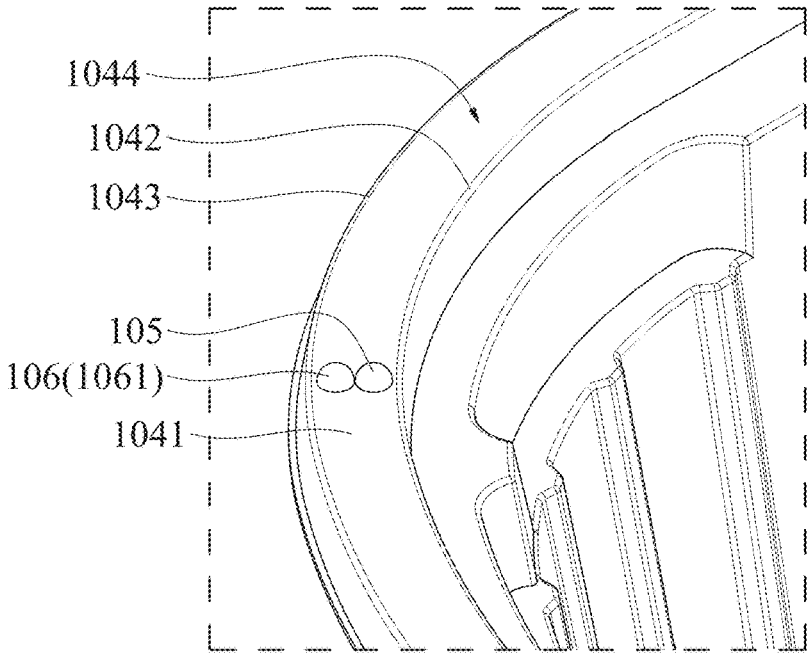
FIG. 13 illustrates an enlarged partial perspective view of a container according to another embodiment of the present application.

On the other hand, please refer to FIG. 12 and FIG. 13, each of which illustrates an enlarged partial perspective view of a container 1 according to another embodiment of the present application. In some embodiments, as shown in FIG. 12, an auxiliary pressure relief protrusion 106 may be in the pressure relief region 1044. The auxiliary pressure relief protrusion 106 has substantially the same structural features as the aforementioned pressure relief protrusion 105 (that is, the auxiliary pressure relief protrusion 106 also protrudes from the peripheral plane 1041 and extends away from the bottom surface 101, and the auxiliary pressure relief protrusion 106 has an auxiliary pressure relief curved surface 1061 configured to be in contact with the sealing film as well), but the auxiliary pressure relief protrusion 106 is not in contact with the inner edge 1042 of the peripheral plane 1041. Besides this, the position of the auxiliary pressure relief protrusion 106 is not limited. For example, the auxiliary pressure relief protrusion 106 may be separated from the pressure relief protrusion 105 (as shown in FIG. 12) or in contact with the pressure relief protrusion 105 (as shown in FIG. 13), or the auxiliary pressure relief protrusion 106 may be in contact with or not in contact with the outer edge 1043 of the peripheral plane 1041. For example, in the embodiment shown in FIG. 12, the auxiliary pressure relief protrusion 106 is not in contact with the outer edge 1043 of the peripheral plane 1041, while in the embodiment shown in FIG. 13, the auxiliary pressure relief protrusion 106 is in contact with the outer edge 1043 of the peripheral plane 1041.

In some embodiments, the auxiliary pressure relief protrusion 106 may be configured to coordinate with the pressure relief protrusion 105. For example, please refer to FIG. 14, where FIG. 14-(1) to FIG. 14-(3) each illustrates an enlarged partial perspective view of a container 1 according to an embodiment of the present application. In the embodiment shown in FIG. 14-(1), two adjacent pressure relief protrusions 105 and one auxiliary pressure relief protrusion 106 are in the pressure relief region 1044. The two pressure relief protrusions 105 are disposed along the extension direction 1041*a* of the peripheral plane 1041. When the two pressure relief protrusions 105 are in a side view from the accommodation space 103, at least part of the auxiliary pressure relief protrusion 106 is between the two adjacent pressure relief protrusions 105 (for example, in the embodiment shown in FIG. 14-(1), the auxiliary pressure relief protrusion 106 is entirely between the two adjacent pressure relief protrusions 105). Under such arrangement, the auxiliary pressure relief protrusion 106 is at least partially placed in the steam flow discharged through the pressure relief passage 105*a*, and thus could disperse the steam flow discharged through the pressure relief passage 105*a*. Therefore, the intensity of discharged steam can be reduced, helping to reduce the risk of injury when the user holds or accidentally touches the pressure relief regions 1044 where the steam is discharged out.

Figure 14:
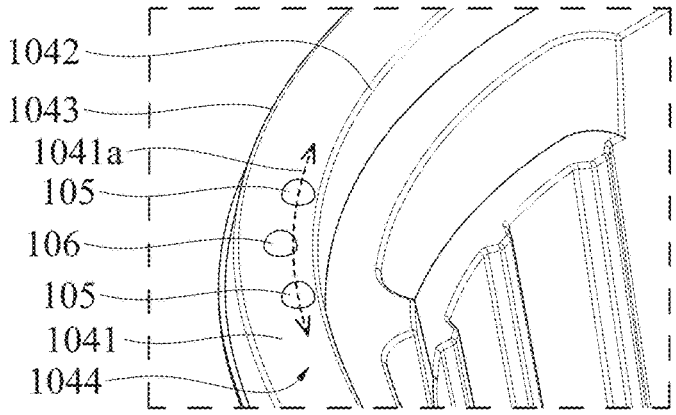
FIG. 14: (1) to (3) illustrate each an enlarged partial perspective view of a container according to another embodiment of the present application.
Figure 14:
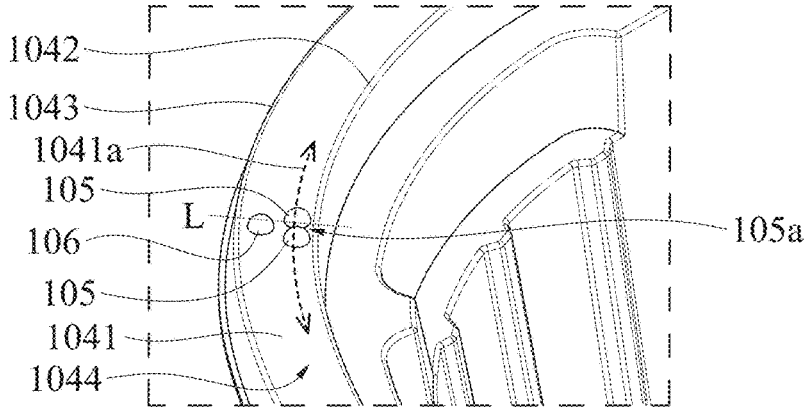
Figure 14:
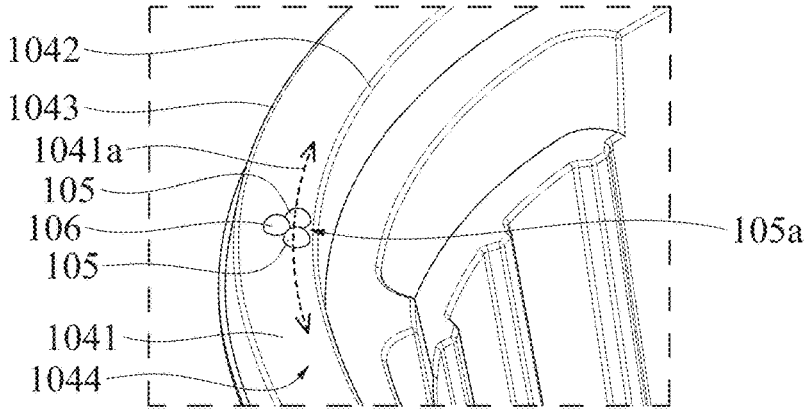

Next, please refer to FIG. 14-(2). The embodiment shown in FIG. 14-(2) is similar to the embodiment shown in FIG. 14-(1), but in the embodiment shown in FIG. 14-(2), the two adjacent pressure relief protrusions 105 in the pressure relief region 1044 are in contact with each other. Under such arrangement, a virtual line L, which passes through the connection point of the two pressure relief protrusions 105 and is perpendicular to the extension direction 1041*a* of the peripheral plane 1041, also passes through the auxiliary pressure relief protrusion 106. As mentioned above, when the two adjacent pressure relief protrusions 105 are in contact with each other, the narrowest pressure relief passage 105*a* can be formed between the two adjacent pressure relief protrusions 105, so that the steam passing through the pressure relief passage 105*a* can be more concentrated. Thus, under the arrangement shown in FIG. 14-(2), the steam flow can be guided by the pressure relief passage 105*a* formed between the two adjacent pressure relief protrusions 105 at first, so that the user can roughly predict the discharge region of the container 1, and then the steam flow will be dispersed by the auxiliary pressure relief protrusion 106. Therefore, the probability of user's injury can be reduced when the user holds or accidentally touches the pressure relief regions 1044 where the steam is discharged out.

Next, please refer to FIG. 14-(3). Furthermore, the embodiment shown in FIG. 14-(3) is similar to the embodiment shown in FIG. 14-(2), but in the embodiment shown in FIG. 14-(3), the auxiliary pressure relief protrusion 106 is in contact with the two pressure relief protrusions 105 at the same time. In other words, in this embodiment, the auxiliary pressure relief protrusion 106 is closest to the two pressure relief protrusions 105 and is also closest to the pressure relief passage 105*a* formed between the two pressure relief protrusions 105. Thus, under such arrangement, the auxiliary pressure relief protrusion 106 can effectively disperse the steam flow discharged from the pressure relief passage 105*a*.

Figure 15:
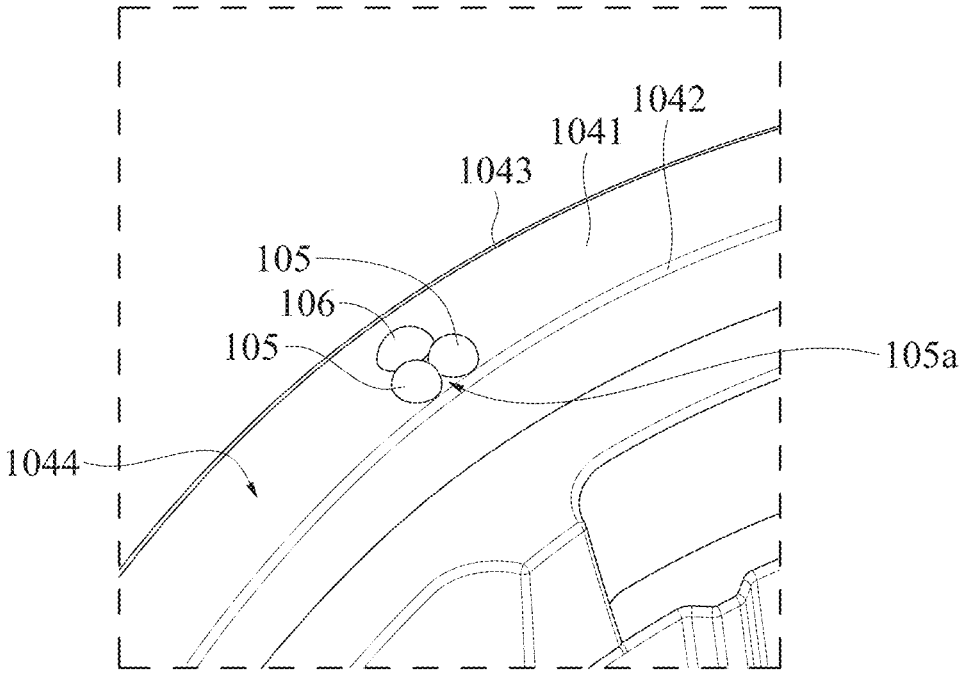
FIG. 15: (1) illustrates an enlarged partial perspective view of a container according to another embodiment of the present application, and (2) illustrates an enlarged partial top view of the container shown in (1).
Figure 15:
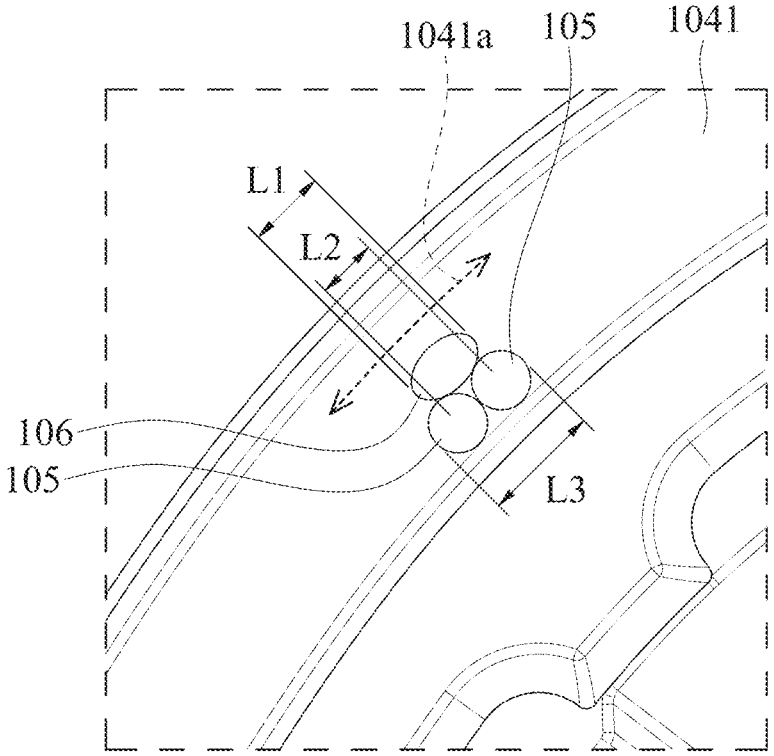

Please refer to FIG. 15, where FIG. 15-(1) illustrates an enlarged partial perspective view of a container 1 according to another embodiment of the present application, and FIG. 15-(2) illustrates an enlarged partial top view of the container 1 shown in FIG. 15-(1). In some embodiments, the structures of the auxiliary pressure relief protrusion 106 and the pressure relief protrusion 105 may be different. For example, the auxiliary pressure relief protrusion 106 and the pressure relief protrusion 105 may have different heights (the term "height" here is to indicate the shortest distance between the peripheral plane 1041 and the highest point of the auxiliary pressure relief protrusion 106 or the shortest distance between the peripheral plane 1041 and the highest point of the pressure relief protrusion 105, respectively), different shapes in the side view and/or different shapes in the top view. For example, as shown in FIG. 15-(2), the auxiliary pressure relief protrusion 106 has an elliptical shape in the top view, while the two pressure relief protrusions 105 both have circular shape in the top view. It is also noted that when the two pressure relief protrusions 105 are in a side view from the accommodation space 103, at least part of the auxiliary pressure relief protrusion 106 is between these two adjacent pressure relief protrusions 105. Therefore, the auxiliary pressure relief protrusion 106 here also can achieve the purpose of dispersing the steam flow discharged through the pressure relief passage 105*a* mentioned above.

Please still refer to FIG. 15-(2). Furthermore, in some embodiments, the maximum width L1 of the auxiliary pressure relief protrusion 106 along the extension direction 1041*a* of the peripheral plane 1041 is not less than the distance L2 between the centers of the two pressure relief protrusions 105, and the maximum width L1 is also not greater than the maximum distance L3 between the distal ends of the two pressure relief protrusions 105 along the extension direction 1041*a* of the peripheral plane 1041. Under such arrangement, it can be ensured that the steam flow discharged between the two pressure relief protrusions 105 can be effectively dispersed (that is, the size of the auxiliary pressure relief protrusion 106 is large enough to effectively disperse the steam flow), and the steam flow will not be excessively dispersed or even blocked and thus failing to be discharged out under such arrangement.

Figure 16:
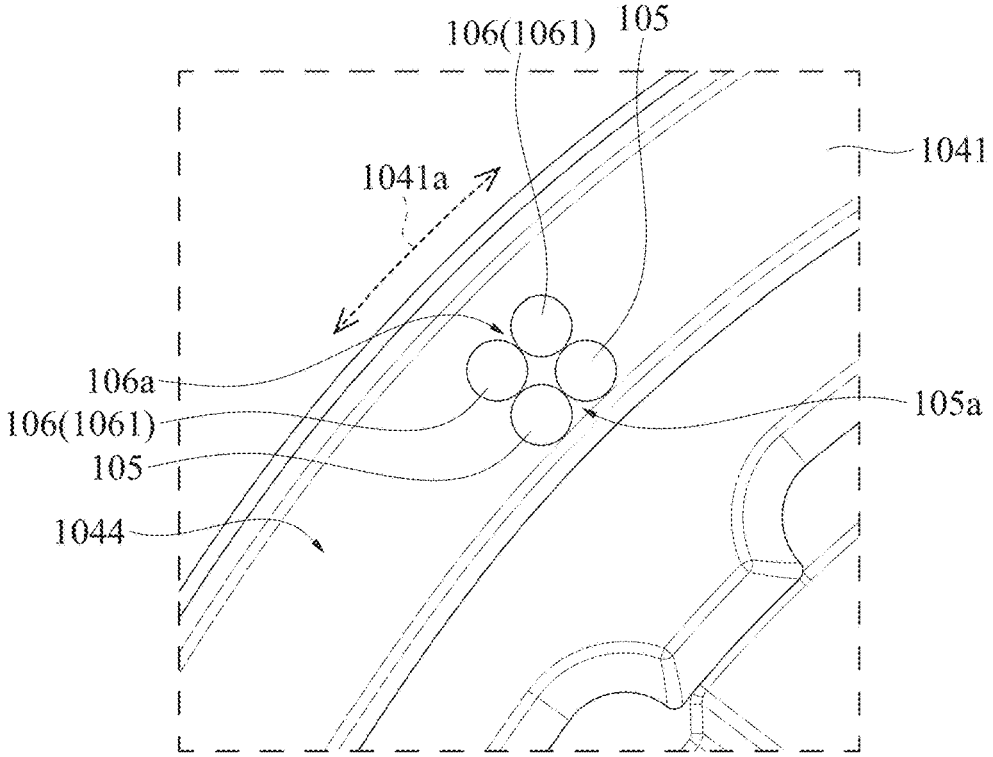
FIG. 16: (1) illustrates an enlarged partial top view of a container according to another embodiment of the present application, and (2) illustrates an enlarged partial perspective view of the container shown in (1).
Figure 16:
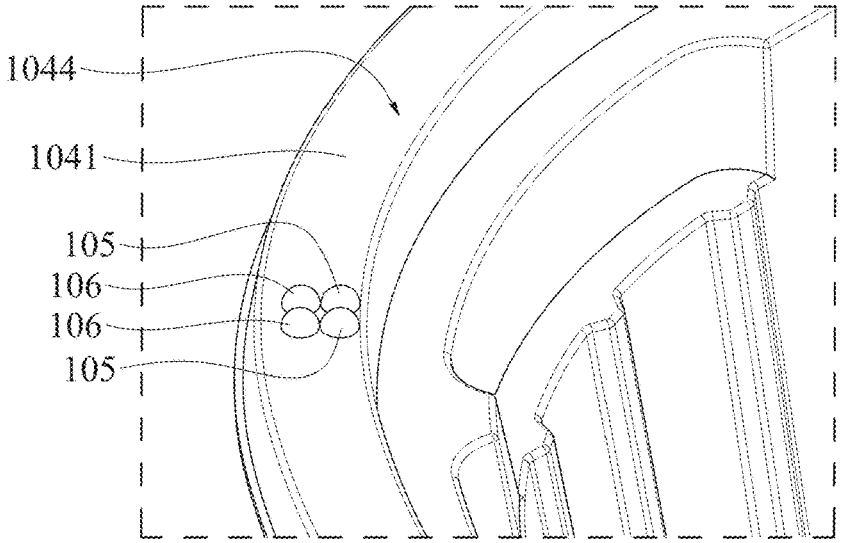

Then, please refer to FIG. 16, where FIG. 16-(1) illustrates an enlarged partial top view of a container 1 according to another embodiment of the present application, and FIG. 16-(2) illustrates an enlarged partial perspective view of the container 1 shown in FIG. 16-(1). FIG. 16-(2) can be regarded as an auxiliary view of FIG. 16-(1). In some embodiments, the pressure relief region 1044 may have multiple pressure relief protrusions 105 and multiple auxiliary pressure relief protrusions 106 at the same time. By forming the auxiliary pressure relief passage 106*a* between the multiple auxiliary pressure relief protrusions 106 and in communication with the pressure relief passage 105*a*, the pressure relief passage 105*a* can be extended and thus the steam flow discharged from the pressure relief passage 105*a* can be further guided by the auxiliary pressure relief passage 106*a*. For example, in the embodiment shown in FIG. 16, in addition to having two adjacent pressure relief protrusions 105 in contact with each other in the pressure relief region 1044, two adjacent auxiliary pressure relief protrusions 106 are also in contact with each other in the pressure relief region 1044. Moreover, one of the two auxiliary pressure relief protrusions 106 is in contact with one of the two pressure relief protrusions 105; and the other one of the two auxiliary pressure relief protrusions 106 is in contact with the other one of the two pressure relief protrusions 105. Under this arrangement, in addition to having a pressure relief passage 105*a* forming between the two pressure relief surfaces 1051 of the two pressure relief protrusions 105, another auxiliary pressure relief passage 106*a* is formed between the two auxiliary pressure relief surfaces 1061 of the two auxiliary pressure relief protrusions 106, and the pressure relief passage 105*a* is in communication with the auxiliary pressure relief passage 106*a*. It should be noted that as long as the steam flow discharged from the pressure relief passage 105*a* can flow into the auxiliary pressure relief passage 106*a*, the pressure relief passage 105*a* is considered to be "in communication with" the auxiliary pressure relief passage 106*a*.

Figure 17:
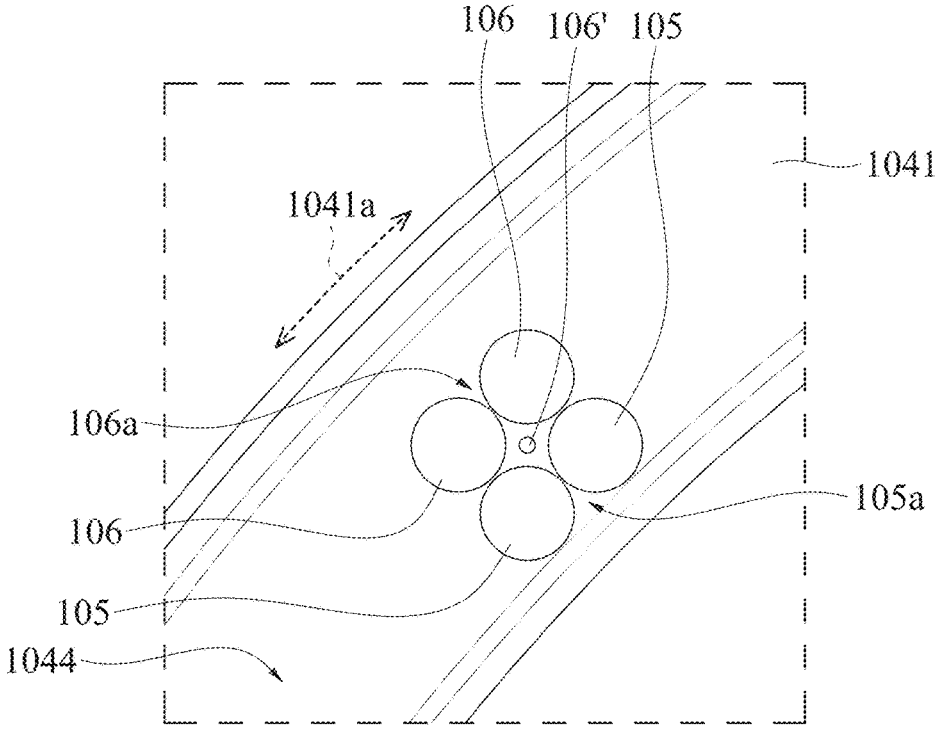
FIG. 17 illustrates an enlarged partial top view of a container according to another embodiment of the present application.

Then, please refer to FIG. 17, which illustrates an enlarged partial top view of a container 1 according to another embodiment of the present application. In some embodiments, as shown in FIG. 17, an additional auxiliary pressure relief protrusion 106' is in the region surrounded by the two adjacent auxiliary pressure relief protrusions 106 in contact with each other and the two adjacent pressure relief protrusions 105 in contact with each other (the term "adjacent" in the "adjacent auxiliary pressure relief protrusions 106" is also to indicate that no other auxiliary pressure relief protrusions 106 are between the two auxiliary pressure relief protrusions 106 along the extension direction 1041*a* of the peripheral plane 1041). By having an auxiliary pressure relief protrusion 106' in the flow path formed by the pressure relief passage 105*a* and the auxiliary pressure relief passage 106*a*, the steam flow discharged through the pressure relief passage 105*a* can be dispersed before entering the auxiliary pressure relief passage 106*a*. Therefore, the steam strength discharged out from the auxiliary pressure relief passage 106*a* can be reduced, which lowers the risk of user's injury when the user grips or accidently touches the pressure relief regions 1044 where the steam is discharged out. It is worth mentioning that, since the steam discharged from the pressure relief passage 105*a* can still flow into the auxiliary pressure relief passage 106*a*, in the embodiment shown in FIG. 17, the pressure relief passage 105*a* and the auxiliary pressure relief passage 106*a* are still in communication with each other.

Figure 18:
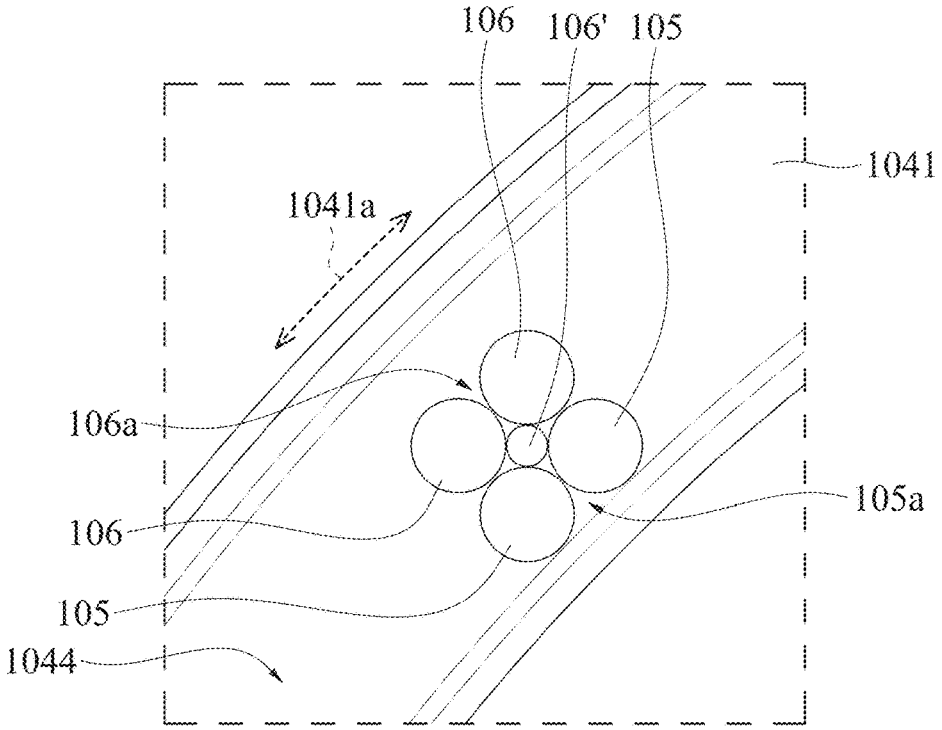
FIG. 18 illustrates an enlarged partial top view of a container according to another embodiment of the present application.

Please refer to FIG. 18, which illustrates an enlarged partial top view of a container 1 according to another embodiment of the present application. In some embodiments, as shown in FIG. 18, the another auxiliary pressure relief protrusion 106' is in the region surrounded by two adjacent auxiliary pressure relief protrusions 106 in contact with each other and two adjacent pressure relief protrusions 105 in contact with each other, and the another auxiliary pressure relief protrusion 106' is in contact with the two auxiliary pressure relief protrusions 106 and the two pressure relief protrusions 105 at the same time. Under this arrangement, the another auxiliary pressure relief protrusion 106' will be closest to the pressure relief protrusions 105 and the auxiliary pressure relief protrusions 106, and the another auxiliary pressure relief protrusion 106' thus will be closest to the pressure relief passage 105*a* formed by the two pressure relief protrusions 105 and closest to the auxiliary pressure relief passage 106*a* formed by the two auxiliary pressure relief protrusions 106. Therefore, under such arrangement, the steam flow discharged from the pressure relief passage 105*a* can be more effectively dispersed and the speed of the steam flow entering the auxiliary pressure relief passage 106*a* can be slowed down. Hence, such arrangement further helps achieve the aforementioned purpose of reducing the steam intensity discharged from the auxiliary pressure relief passage 106*a*, which may further reduce the risk of user's injury when the user grips or accidently touches the pressure relief regions 1044 where the steam is discharged out.

It should be understood that the pressure relief passage 105*a* may also be formed between two pressure relief protrusions 105 which are not in contact with each other, and the auxiliary pressure relief passage 106*a* may also be formed between two auxiliary pressure relief protrusions 106 which are not in contact with each other. Moreover, the pressure relief passage 105*a* and the auxiliary pressure relief passage 106*a* may be in communication with each other even if the pressure relief passage 105*a* and the auxiliary pressure relief passage 106*a* are not directly connected. Therefore, in some embodiments, the two adjacent pressure relief protrusions 105 forming the pressure relief passage 105*a* are not in contact with each other, the two adjacent auxiliary pressure relief protrusions 106 forming the auxiliary pressure relief passage 106*a* are not in contact with each other, and/or any of the two adjacent pressure relief protrusions 105 is not in contact with any of the two adjacent auxiliary pressure relief protrusions 106. These are all options that can be chosen.

Figure 19:
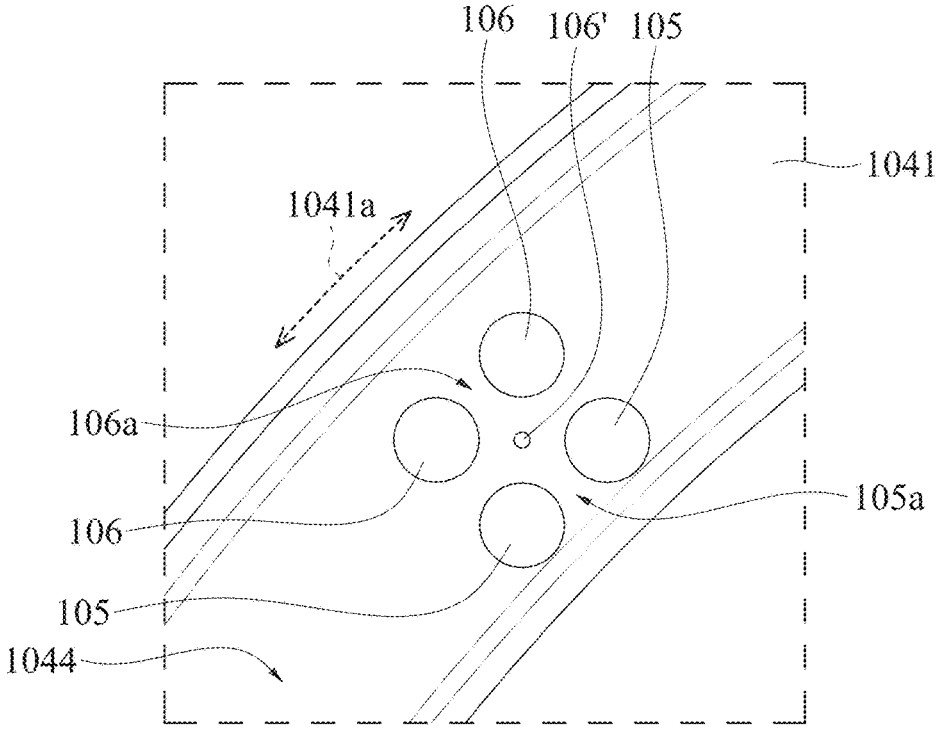
FIG. 19 illustrates an enlarged partial top view of a container according to another embodiment of the present application.

For example, please refer to FIG. 19. In some embodiments, the two adjacent pressure relief protrusions 105 are not in contact with each other, and the two adjacent auxiliary pressure relief protrusions 106 are not in contact with each other as well. Moreover, any of the two adjacent pressure relief protrusions 105 is not in contact with any of the two adjacent auxiliary pressure relief protrusions 106. In these embodiments, the pressure relief passage 105*a* is still formed between the two pressure relief protrusions 105, and the auxiliary pressure relief passage 106*a* is still formed between the two auxiliary pressure relief protrusions 106. In addition, because the steam discharged from the pressure relief passage 105*a* can still flow into the auxiliary pressure relief passage 106*a*, so that in these embodiments, the pressure relief passage 105*a* and the auxiliary pressure relief passage 106*a* are still in communication with each other.

Please still refer to FIG. 19. As previously mentioned, in some embodiments, the another auxiliary pressure relief protrusion 106' may be disposed in the region surrounded by the two auxiliary pressure relief protrusions 106 and the two pressure relief protrusions 105 so as to disperse the steam flow discharged from the pressure relief passage 105*a*, thereby reducing the steam intensity discharged out from the auxiliary pressure relief passage 106*a*. Furthermore, in other embodiments shown in FIG. 20, the another auxiliary pressure relief protrusion 106' is in contact with the two auxiliary pressure relief protrusions 106 and the two pressure relief protrusions 105 at the same time, so that the steam flow discharged from the pressure relief passage 105*a* can be dispersed effectively and thus the speed of the steam flow entering the auxiliary pressure relief passage 106*a* can be slowed down.

In some embodiments, the pressure relief region 1044 may repeatedly have the aforementioned protrusion configuration. For example, please refer to FIG. 21 and FIG. 22, which illustrate enlarged partial top views of the container 1 according to different embodiments of the present application. The embodiments shown in FIG. 21 and FIG. 22 can be regarded as repeatedly having the protrusion configurations shown in FIG. 18 and FIG. 20, respectively, in the pressure relief region 1044. Specifically, in the embodiment shown in FIG. 21, the pressure relief region 1044 on the peripheral plane 1041 has three pressure relief protrusions 105 sequentially in contact with each other, and the pressure relief region 1044 on the peripheral plane 1041 also has three auxiliary pressure relief protrusions 106 arranged along the extension direction 1041*a* of the peripheral plane 1041 sequentially in contact with each other. In addition, each of the three pressure relief protrusions 105 is in contact with a corresponding one of the three auxiliary pressure relief protrusions 106. Furthermore, an additional auxiliary pressure relief protrusion 106' is disposed in each of the two regions surrounded by the six protrusions, and each of the additional auxiliary pressure relief protrusions 106' is in contact with the corresponding two auxiliary pressure relief protrusions 106 and the corresponding two pressure relief protrusions 105 which surround the additional auxiliary pressure relief protrusion 106'.

Figure 21:
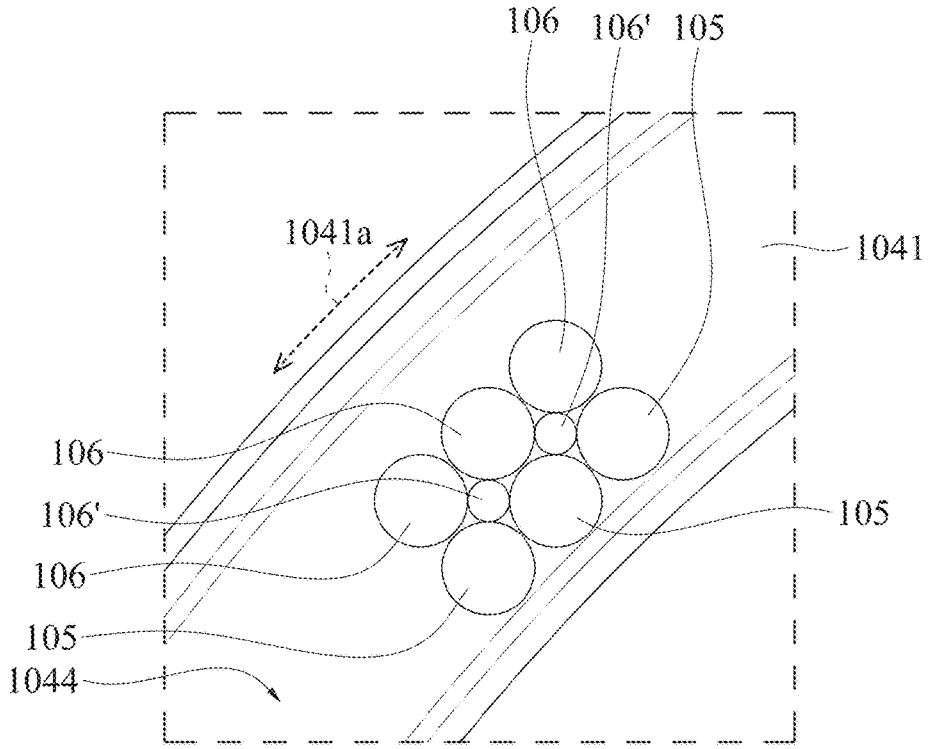
FIG. 21 illustrates an enlarged partial top view of a container according to another embodiment of the present application.

In the embodiments shown in FIG. 21, both sides of the protrusion configurations in the pressure relief region 1044 have the configuration shown in FIG. 18 along the extension direction 1041*a* of the peripheral plane 1041. In other words, in these embodiments, both sides of the protrusion configuration in the pressure relief region 1044 also have the aforementioned configuration of "the two adjacent auxiliary pressure relief protrusions 106 in contact with each other and the two adjacent pressure relief protrusions 105 in contact with each other together surround a region, the another auxiliary pressure relief protrusion 106' is disposed in the region, and the another auxiliary pressure relief protrusion 106' is in contact with the two auxiliary pressure relief protrusions 106 and the two pressure relief protrusions 105." Accordingly, the configuration of the embodiments shown in FIG. 21 can be regarded as repeatedly having the protrusion configuration shown in FIG. 18 in the pressure relief region 1044 on the peripheral plane 1041.

Figure 22:
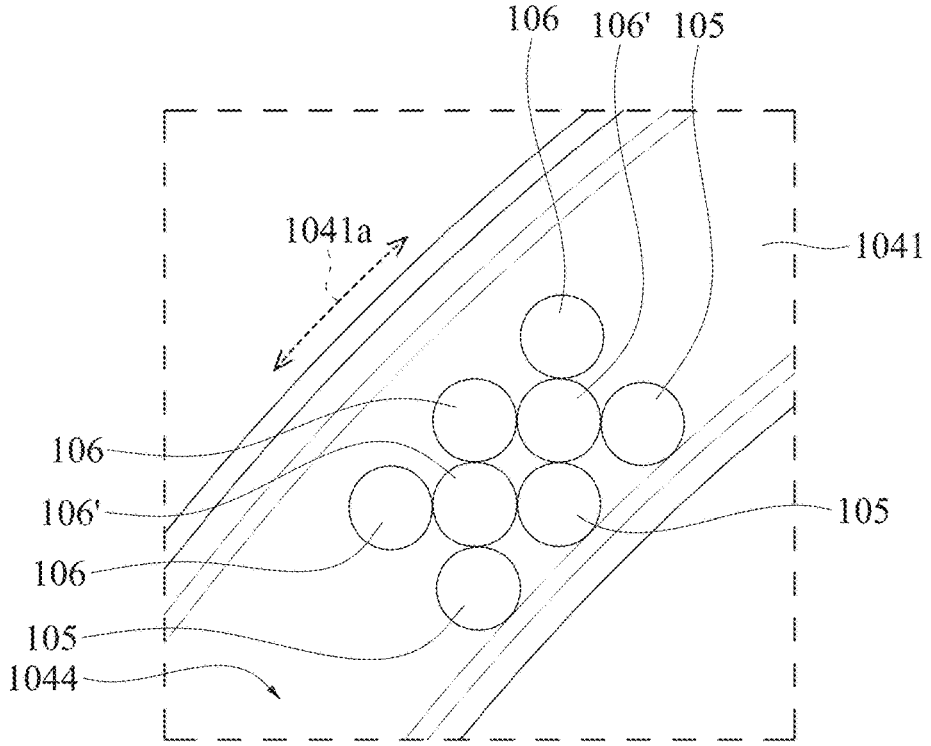
FIG. 22 illustrates an enlarged partial top view of a container according to another embodiment of the present application.

Please refer to FIG. 22, which illustrates an enlarged partial top view of the container 1 according to another embodiment of the present application. The embodiment shown in FIG. 22 is similar to what was described above; however, in the embodiments shown in FIG. 22, both sides of the protrusion configurations in the pressure relief region 1044 have the configuration shown in FIG. 20 along the extension direction 1041*a* of the peripheral plane 1041. In other words, in these embodiments, both sides of the protrusion configuration in the pressure relief region 1044 have the aforementioned configuration of "the two adjacent auxiliary pressure relief protrusions 106 not in contact with each other and two adjacent pressure relief protrusions 105 not in contact with each other together surround a region, the another auxiliary pressure relief protrusion 106' is disposed in the region, and the another auxiliary pressure relief protrusion 106' is in contact with the two auxiliary pressure relief protrusions 106 and the two pressure relief protrusions 105." Accordingly, the configuration of the embodiments shown in FIG. 22 can be regarded as repeatedly having the protrusion configuration shown in FIG. 20 in the pressure relief region 1044 on the peripheral plane 1041.

Figure 20:
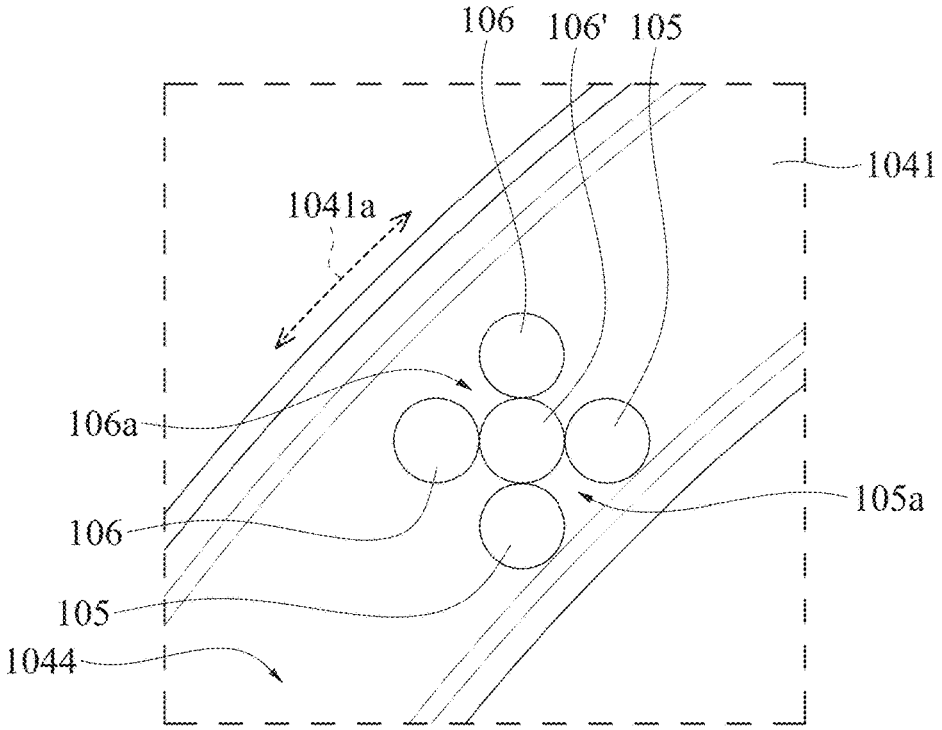
FIG. 20 illustrates an enlarged partial top view of a container according to another embodiment of the present application.

The number of repetitions of the aforementioned protrusion configuration is not particularly limited. In addition, although the aforementioned repetition is implemented in the manner of "having an overlap between two configurations (which indicates some elements are shared between the two configurations)", the repetition may be implemented without overlapping. To illustrate it more clearly, please refer to FIG. 22 first. The configuration of the embodiment shown in FIG. 22 can be regarded as that two sets of the configurations shown in FIG. 20 on both sides along the extension direction 1041*a* share a pressure relief protrusion 105 and an auxiliary pressure relief protrusion 106 in the middle, hence the two sets of the configurations shown in FIG. 20 are overlapping in the embodiment shown in FIG. 22. On the other hand, in some other embodiments, the two sets of the configurations shown in FIG. 20 may be individually arranged in the pressure relief region 1044 without overlapping. In this case, no shared pressure relief protrusion 105 and auxiliary pressure relief protrusion 106 is between the two configurations shown in FIG. 20.

Figure 23:
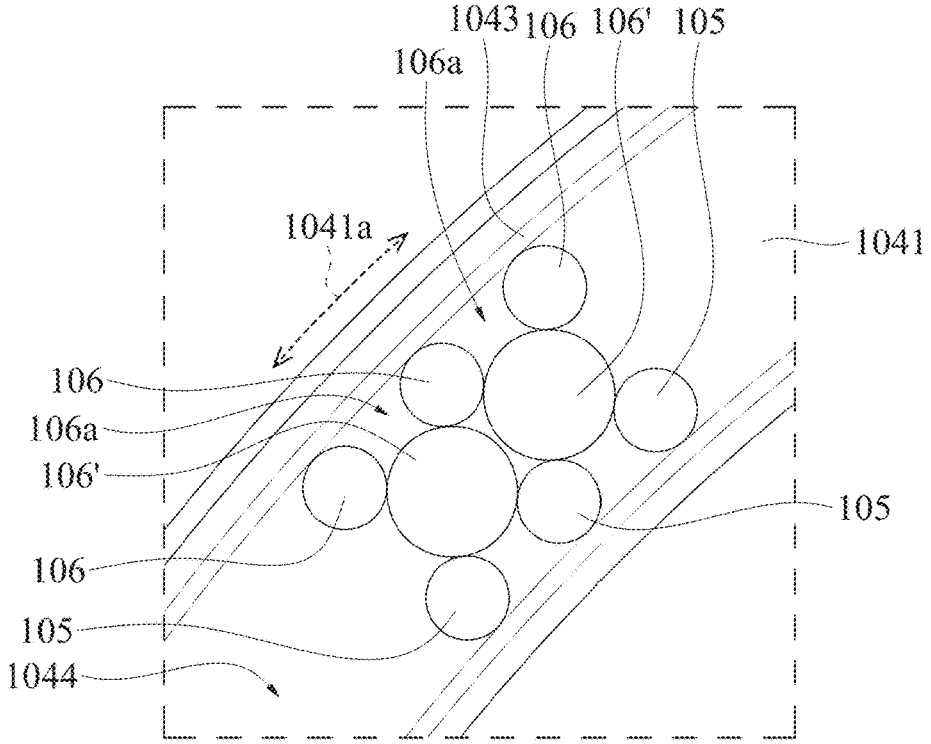
FIG. 23 illustrates an enlarged partial top view of a container according to another embodiment of the present application.

In some embodiments, among the auxiliary pressure relief protrusions 106 that are closest to the outer edge 1043 of the peripheral plane 1041, at least two adjacent auxiliary pressure relief protrusions 106 thereof contact the outer edge 1043 of the peripheral plane 1041. For example, in the embodiment shown in FIG. 23, although the configuration is similar to the configuration shown in FIG. 22, the three auxiliary pressure relief protrusions 106 arranged along the extension direction 1041*a* of the peripheral plane 1041 and closest to the outer edge 1043 are all in contact with the outer edge 1043. Therefore, the auxiliary pressure relief passage 106*a* formed by each of the two adjacent auxiliary pressure relief protrusions 106 can be nearer the outer edge 1043, thereby facilitating the discharge of the steam flow leaving from the auxiliary pressure relief passage 106*a* to the external environment.

Figure 24:
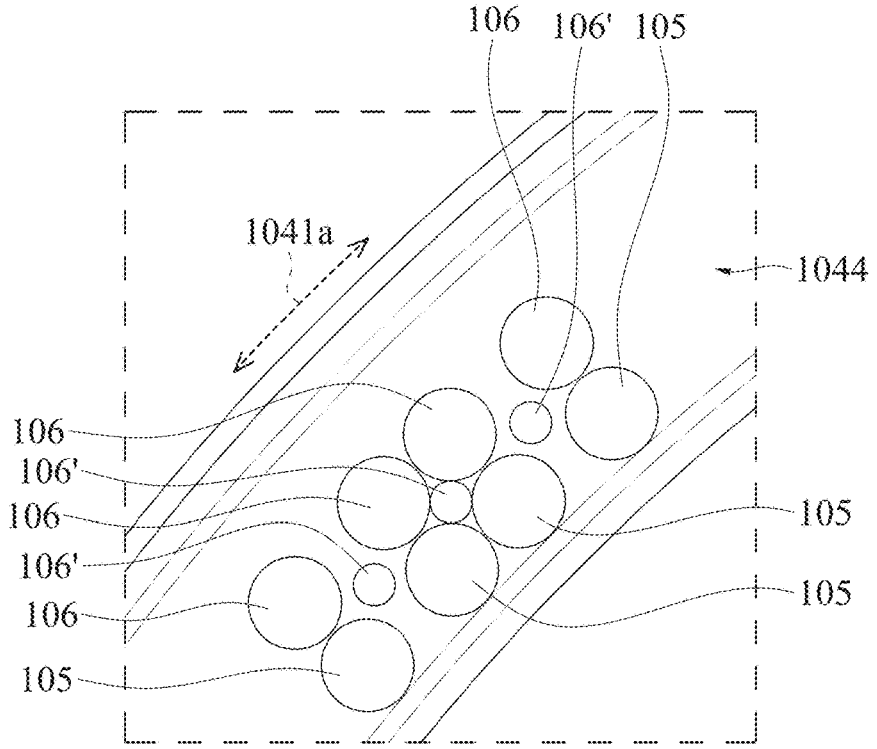
FIG. 24 illustrates an enlarged partial top view of a container according to another embodiment of the present application.

Next, please refer to FIG. 24. In some embodiments, the pressure relief region 1044 on the peripheral plane 1041 may have multiple types of the aforementioned protrusion configurations at the same time. For example, in some embodiments shown in FIG. 24, the pressure relief region 1044 on the peripheral plane 1041 has the configuration shown in FIG. 18, and the pressure relief region 1044 on the peripheral plane 1041 further has the protrusion configuration shown in FIG. 13 at each of both sides of the configuration shown in FIG. 18 along the extension direction 1041*a* of the peripheral plane 1041. Specifically, the middle of the protrusion configuration of the embodiment shown in FIG. 24 can be regarded as having the configuration shown in FIG. 18 of "the two adjacent auxiliary pressure relief protrusions 106 in contact with each other and the two adjacent pressure relief protrusions 105 in contact with each other together surround a region, the another auxiliary pressure relief protrusion 106' is in this region, and the another auxiliary pressure relief protrusion 106' is in contact with the two auxiliary pressure relief protrusions 106 and the two pressure relief protrusions 105." Furthermore, each of both sides of the protrusion configuration of the embodiment shown in FIG. 24 respectively has a pressure relief protrusion 105 and an auxiliary pressure relief protrusion 106 in contact with this pressure relief protrusion 105. The pressure relief protrusion 105 and the auxiliary pressure relief protrusion 106 are arranged along a direction perpendicular to the extension direction 1041*a* of the peripheral plane 1041. Under such arrangement, additional pressure relief paths can be configured to both sides of the configuration shown in FIG. 18 to adjust the discharge mode of the discharged steam.

Please still refer to FIG. 24. Moreover, if controlling the amount of steam discharged from the additional pressure relief paths on both sides of the protrusion configuration of the embodiment shown in FIG. 24 is further requested, in some embodiments, another auxiliary pressure relief protrusions 106' may be disposed in the additional pressure relief path. In other words, in some embodiments, the another auxiliary pressure relief protrusions 106' may be disposed in the region surrounded by the two adjacent auxiliary pressure relief protrusions 106 and the two adjacent pressure relief protrusions 105 at each of the two sides of the protrusion configuration.

In summary, the container 1 in embodiments of group 1 has a pressure relief protrusion 105 protruding outward from the peripheral plane 1041. Since, comparing to the attachment between the sealing film and the peripheral plane 1041, the attachment between the sealing film and the curved surface is relatively poorer. Thus, when the container 1 is attached with the sealing film and the accommodation space 103 is closed, a pseudo-adhesive region of the sealing film will be formed on the pressure relief protrusion 105 and/or around the pressure relief protrusion 105. As described above, due to poorer attachment of the sealing film in the pseudo-adhesive region, when the steam generated in the accommodation space 103 presses the sealing film, the steam can enter this structurally weak region and push open the sealing film, to achieve a pressure relief effect.

Embodiments of Group 2

Figure 26:
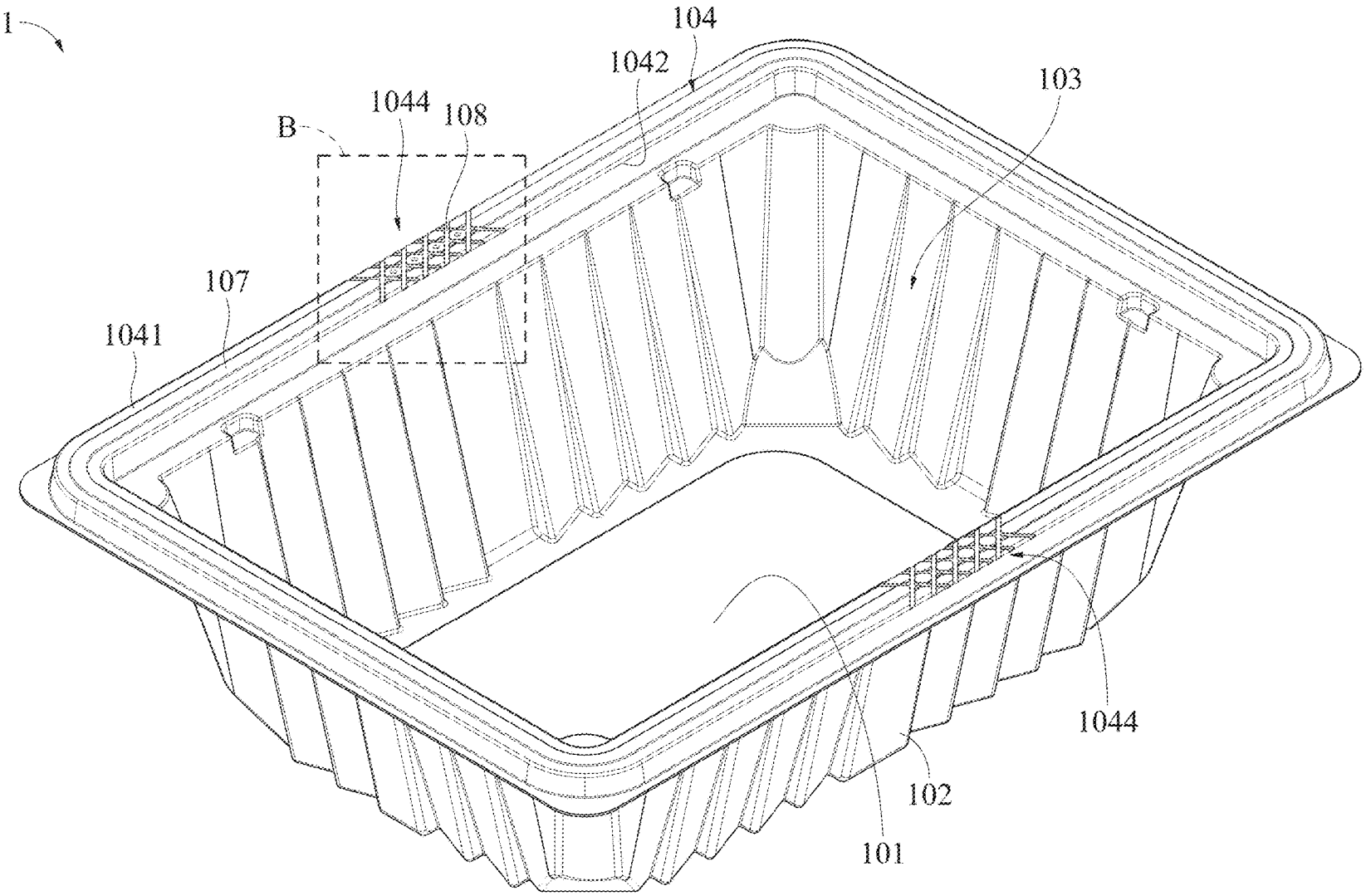
FIG. 26 illustrates a perspective view of a container according to another embodiment of the present application.

As an embodiment of group 2, referring to FIG. 26, FIG. 26 illustrates a perspective view of a container 1 according to an embodiment of the present application. The difference from Embodiment 1 is that in this embodiment, the peripheral plane 1041 is provided with a convex strip 107 and a groove 108. The convex strip 107 protrudes from the peripheral plane 1041, the groove 108 is in contact with at least one of the inner edge 1042 or the outer edge 1043 (can further refer to FIG. 27 and FIG. 28), and the groove 108 at least partially overlaps the convex strip 107. The specific implementation may be further described below.

Still refer to FIG. 26. Similar to the container in FIG. 1, in this embodiment, the container 1 for food to be heated also includes a bottom surface 101, a side wall 102 connected to the bottom surface 101 and a peripheral portion 104 connected to the side wall 102. The side wall 102 and the bottom surface 101 together form an accommodation space 103 for accommodating items such as food, and the peripheral portion 104 surrounds the accommodation space 103. The container 1 has an opening on the side opposite to the bottom surface 101. When the container 1 is not attached with a sealing film, the accommodation space 103 is in communication with the outside of the container 1 through the opening. The peripheral portion 104 has a peripheral plane 1041 configured to be in contact with the sealing film when the container 1 is attached with the sealing film. The peripheral portion 104 can completely surround the accommodation space 103 or discontinuously (i.e., partially) surround the accommodation space 103. In the embodiment shown in FIG. 26, the peripheral portion 104 completely surrounds the accommodation space 103.

Figure 27:
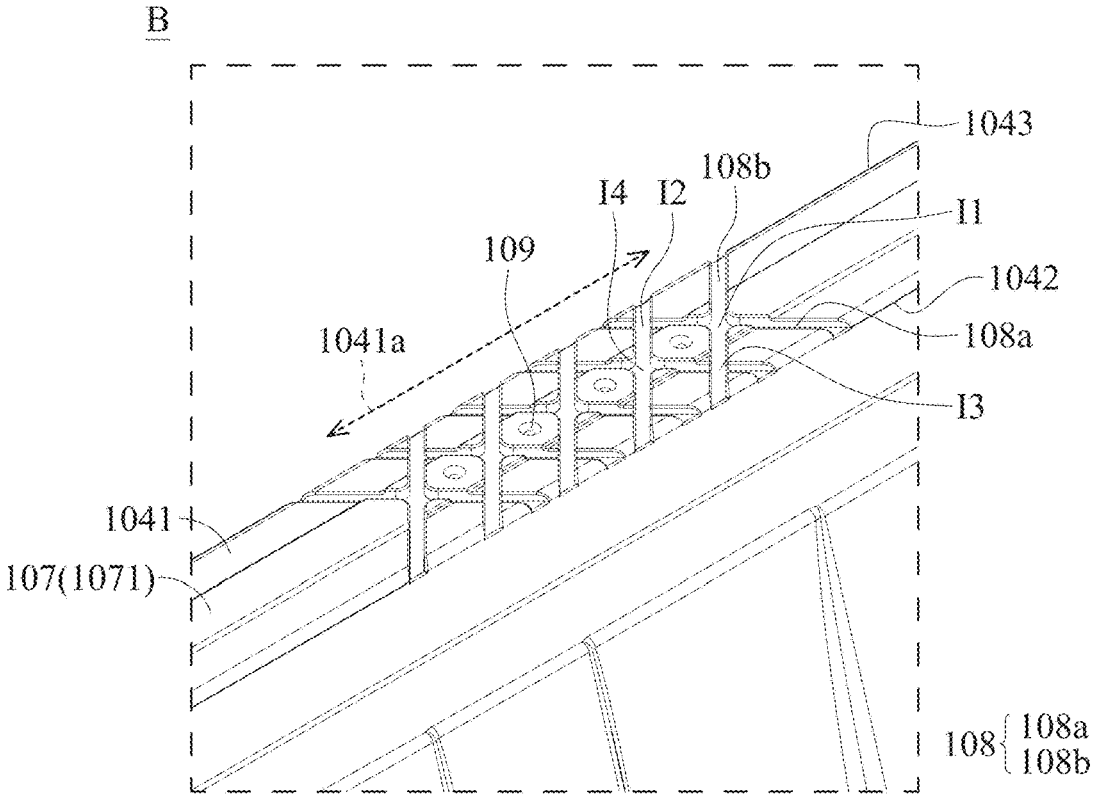
FIG. 27 illustrates an enlarged partial perspective view of the container in FIG. 26.

Please continue to refer to FIG. 26 and also refer to FIG. 27. FIG. 27 illustrates an enlarged partial (that is, a dotted box B in FIG. 26) perspective view of the container 1 for food to be heated in FIG. 26. In this embodiment, the peripheral plane 1041 of the peripheral portion 104 also has an inner edge 1042 adjacent to the accommodation space 103 and an outer edge 1043 away from the accommodation space 103. The peripheral plane 1041 has a convex strip 107 that protrudes from the peripheral plane 1041 and extends away from the bottom surface 101. The convex strip 107 is not in contact with the inner edge 1042 and the outer edge 1043. An extension direction of the convex strip 107 is parallel to an extension direction 1041*a* of the peripheral plane 1041. The convex strip 107 has a top surface 1071, and the top surface 1071 is parallel to the peripheral plane 1041. In this embodiment, the convex strip 107 could completely surround the accommodation space 103 (as shown in FIG. 26), or discontinuously (i.e., partially) surround the accommodation space 103. In addition, a groove 108 is provided on the peripheral plane 1041. The groove 108 is in contact with at least one of the inner edge 1042 or the outer edge 1043, and the groove 108 at least partially overlaps the convex strip 107.

Still refer to FIG. 26 and FIG. 27. As described above, the plastic sealing film can be hot-pressed from top onto the peripheral plane 1041 of the peripheral portion 104 of the container 1 by a device such as a sealing machine. In this embodiment, since there are convex strips 107 on the peripheral plane 1041, when the container 1 is attached with the sealing film, the sealing film may be attached to the peripheral plane 1041 and the top surface 1071 of the convex strip 107. Since the convex strips 107 form a step difference on the peripheral plane 1041, the convex strips 107 may reduce the adhesion effect between the sealing film and the peripheral plane 1041. In addition, since the peripheral portion 104 has a groove 108 that at least partially overlaps the convex strip 107, the groove 108 further reduces the area of the top surface 1071 of the convex strip 107, so that the groove 108 may further reduce the adhesion effect between the sealing film and the convex strip 107. In this way, the sealing film forms a pseudo-adhesive region in which the convex strip 107 and the groove 108 overlap. Further, the groove 108, the peripheral plane 1041, and the top surface 1071 of the convex strip 107 are respectively located at three different heights, namely, low, middle, and high, so that the groove 108, the peripheral plane 1041, and the top surface 1071 may be regarded as forming a stepped structure together. When the sealing film closes the accommodation space 103 and is attached to the stepped structure, the sealing film covers the top surface 1071 and is attached to a part of the peripheral plane 1041. In this case, as described above, the top surface 1071 has a reduced contact area with a sealing film due to the grooves 108, and the peripheral plane 1041 has a reduced contact area with a sealing film due to the convex strip 107 and the groove 108.

Due to poorer attachment of the sealing film in the pseudo-adhesive region, when the steam generated through heating in the accommodation space 103 presses the sealing film, the steam can enter this structurally weak region and push open the sealing film, so that the container 1 still has the pressure relief function in a sealed state.

Please continue to refer to FIG. 26 and FIG. 27. As described before, since the region with the groove 108 on the convex strip 107 may be used to help the container 1 release pressure, the region with both the convex strip 107 and the groove 108 on the peripheral plane 1041 may be regarded as a pressure relief region 1044 with a pressure relief structure. It is to be noted that, in some embodiments, the extension direction of the convex strip 107 only needs to be parallel to the extension direction 1041*a* of the peripheral plane at the pressure relief region 1044. In addition, depending on the demands, one or more pressure relief regions 1044 may be configured/defined on the peripheral plane 1041. For example, as shown in FIG. 26, in this embodiment, it may be considered that two pressure relief regions 1044 are on the peripheral plane 1041, and the two pressure relief regions 1044 are respectively on the peripheral plane 1041 at two sides of the container 1.

Figure 28:
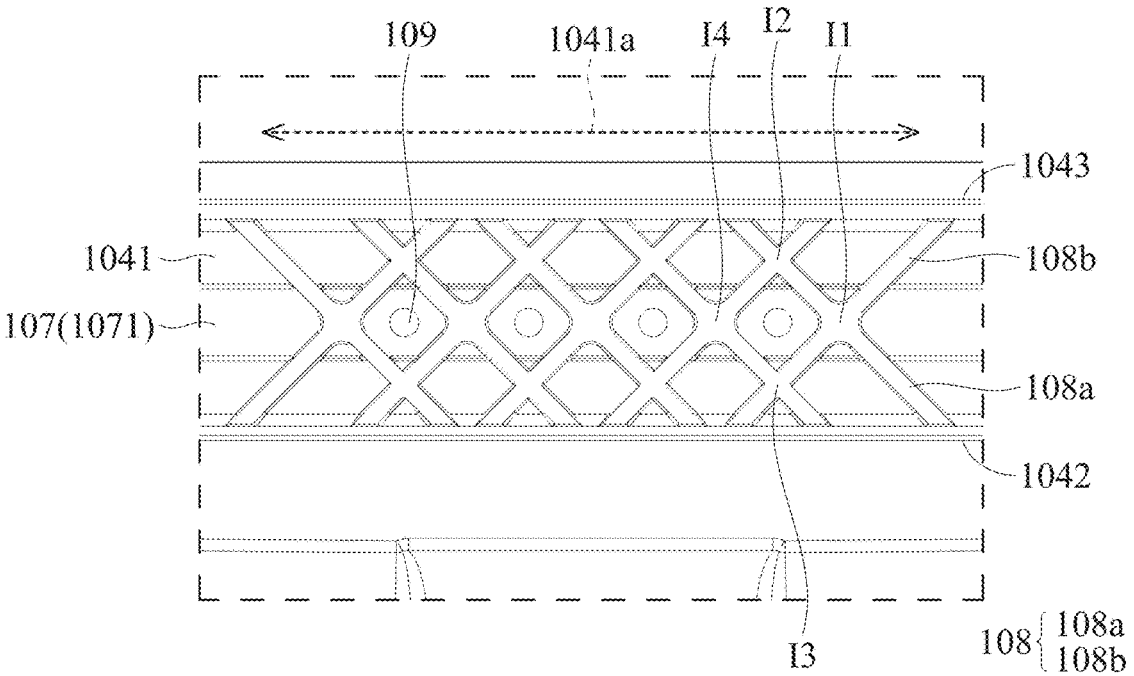
FIG. 28 illustrates an enlarged partial top view of the container in FIG. 26.

Next, refer to FIGS. 26, 27 and 28. FIG. 28 illustrates an enlarged partial top view of the container 1 in FIG. 26. In this embodiment, the groove 108 extends from the inner edge 1042 to the outer edge 1043, that is, the groove 108 contacts not only the inner edge 1042 but also the outer edge 1043. Moreover, an extension direction of the groove 108 is not perpendicular to the extension direction 1041*a* of the peripheral plane 1041. By extending the groove 108 from the inner edge 1042 to the outer edge 1043, the groove 108 may be used as an additional channel for steam, to help adjust pressure balance inside and outside the container 1. Furthermore, because the extension direction of the groove 108 is not perpendicular to the extension direction 1041*a* of the peripheral plane 1041, even if the container 1 contains foods requiring a higher degree of sealing such as food with high water content, compared with a groove that the extension direction thereof is perpendicular to the extension direction 1041*a* of the peripheral plane 1041, water is less likely to flow out from the container 1.

Refer to FIG. 27 and FIG. 28. In this embodiment, the groove 108 includes a first groove 108*a* and a second groove 108*b*. An extension direction of the first groove 108*a* is different from an extension direction of the second groove 108*b*, that is, the extension direction of the first groove 108*a* is not parallel to the extension direction of the second groove 108*b*. For example, an angle between the extension direction of the first groove 108*a* and the extension direction of the second groove 108*b* is in a range of 80 degrees to 100 degrees. Moreover, in this embodiment, the first groove 108*a* and the second groove 108*b* intersect to form an intersection point I1, and the intersection point I1 is located on the convex strip 107. By making the extension direction of the first groove 108*a* different from the extension direction of the second groove 108*b*, and making the intersection point I1 between the first groove 108*a* and the second groove 108*b* located on the convex strip 107, the top surface 1071 of the convex strip 107 may be divided into a plurality of sub-regions, to further reduce the adhesion effect between the sealing film and the convex strip 107.

Referring to FIG. 27 and FIG. 28, in some embodiments, the groove 108 may have a plurality of first grooves 108*a* having the same extension direction and a plurality of second grooves 108*b* having the same extension direction. Moreover, in some embodiments, taking two first grooves 108*a* and the two second grooves 108*b* closest to the upper right in FIG. 27 as an example (two rightmost first grooves 108*a* and two second grooves 108*b* in FIG. 28), it can be seen that any one of the two first grooves 108*a* may intersect with the two second grooves 108*b* to form two intersection points. Specifically, in FIG. 27, the upper rightmost first groove 108*a* and the two upper rightmost second grooves 108*b* form intersection points I1 and I2 respectively. The other first groove 108*a* and the two upper rightmost second grooves 108*b* form intersection points I3 and I4 respectively. By intersecting the plurality of first grooves 108*a* and the plurality of second grooves 108*b*, a network may be formed between the plurality of grooves 108 to more evenly disperse the steam exhausted through these additional channels.

Still referring to FIG. 27 and FIG. 28, in some embodiments, in addition to having the feature "any one of the two first grooves 108*a* intersecting the two second grooves 108*b* to form two intersection points," the container 1 further includes a feature that "one of the two intersection points being located on the convex strip 107." For example, in the embodiment shown in FIG. 27, the intersection point I1 among the intersection point I1 and the intersection point I2 is located on the convex strip 107, and the intersection point I4 among the intersection point I3 and the intersection point I4 is located on the convex strip 107. With such arrangement, the top surface 1071 of the convex strip 107 may be divided into independent sub-regions, to further reduce the adhesion effect between the sealing film and the convex strip 107. Moreover, in some embodiments, the convex strip 107 has a recess 109, and the recess 109 is located between two adjacent first grooves 108*a* and two adjacent second grooves 108*b*. In this embodiment, the recess 109 is located on the convex strip 107 in a region defined by the intersection points I1, I2, I3, and I4, to further reduce the area of the top surface 1071 of the convex strip 107 in this region, thereby reducing the adhesion effect between the sealing film and the convex strips 107.

Another embodiment of the pressure relief region 1044 is described below.

Figure 29:
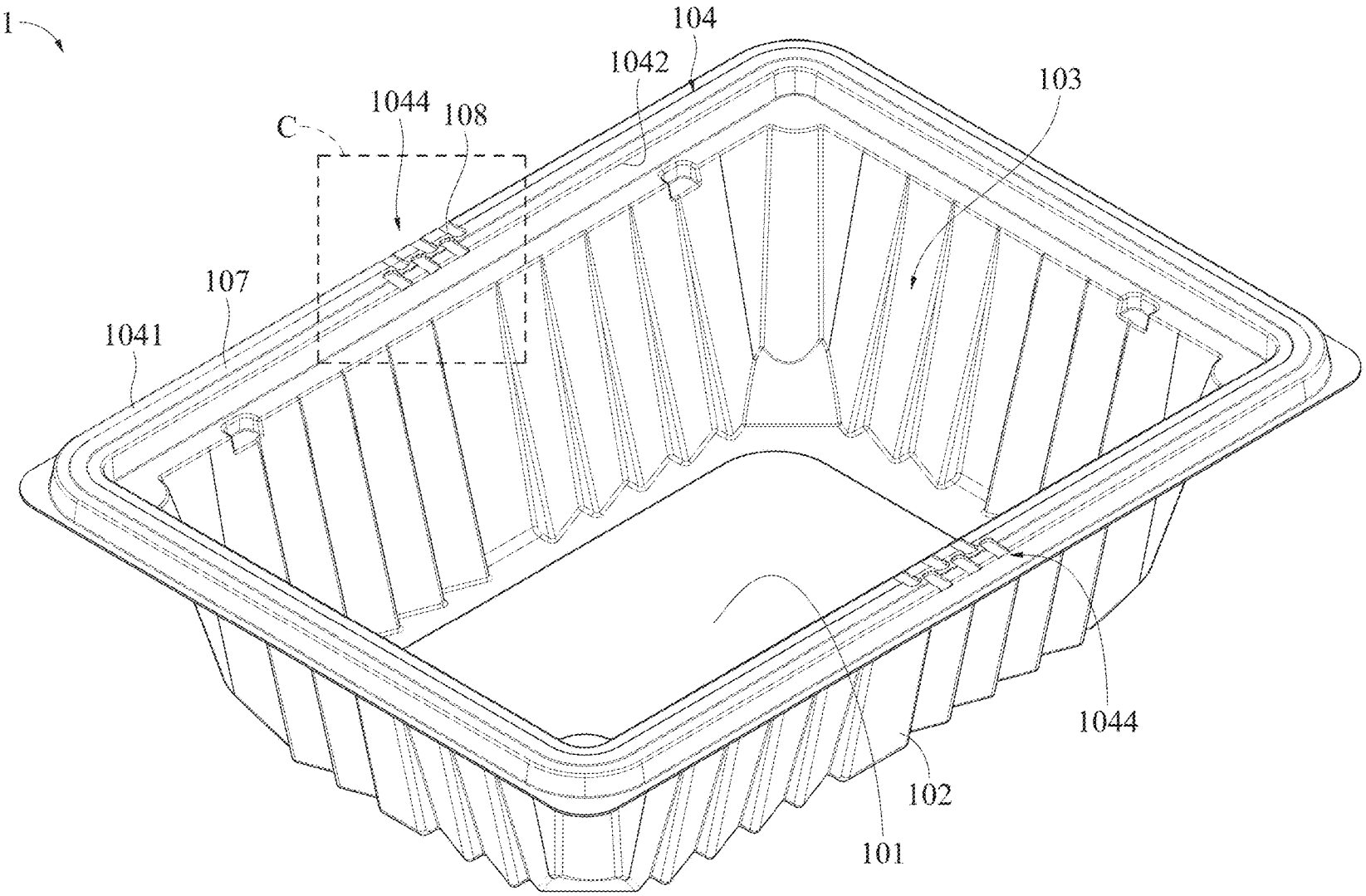
FIG. 29 illustrates a perspective view of a container according to another embodiment of the present application.

Please refer to FIG. 29. FIG. 29 illustrates a perspective view of a container 1 according to an embodiment of the present application. Similar to the container in FIG. 26, in this embodiment, the container 1 also includes a bottom surface 101, a side wall 102 connected to the bottom surface 101, and a peripheral portion 104. The side wall 102 and the bottom surface 101 together form an accommodation space 103 for accommodating items such as food, and the peripheral portion 104 surrounds the accommodation space 103. In the embodiment shown in FIG. 29, the peripheral portion 104 completely surrounds the accommodation space 103. The peripheral portion 104 has a peripheral plane 1041 configured to be in contact with the sealing film when the container 1 is attached with the sealing film.

Figure 30:
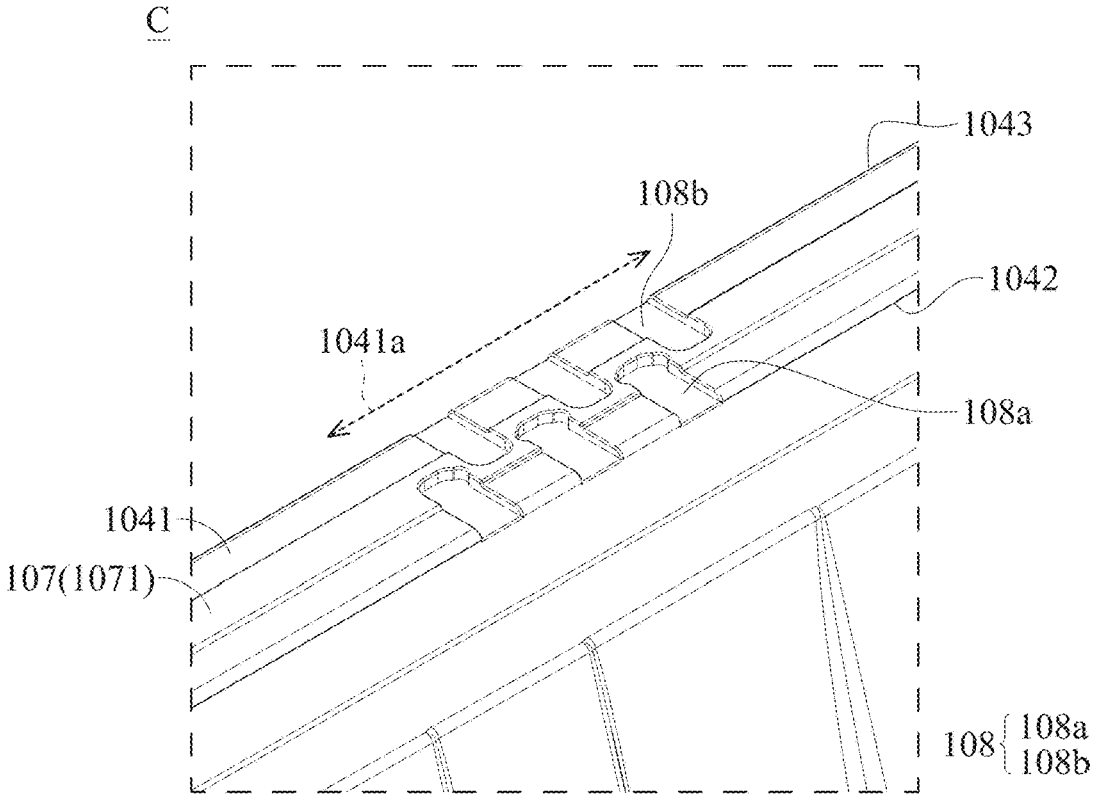
FIG. 30 illustrates an enlarged partial perspective view of the container in FIG. 29.

Next, continue to refer to FIG. 29 and FIG. 30. FIG. 30 illustrates an enlarged partial (that is, a dotted box C in FIG. 29) perspective view of the container 1 for food to be heated in FIG. 29. Similar to the embodiment in FIG. 26, in this embodiment, the peripheral plane 1041 also has a convex strip 107 that protrudes from the peripheral plane 1041 and extends away from the bottom surface 101. The convex strip 107 is not in contact with the inner edge 1042 and the outer edge 1043. An extension direction of the convex strip 107 is parallel to an extension direction 1041*a* of the peripheral plane. The convex strip 107 has a top surface 1071, and the top surface 1071 is parallel to the peripheral plane 1041. A groove 108 is provided on the peripheral plane 1041. The groove 108 is in contact with at least one of the inner edge 1042 or the outer edge 1043, and the groove 108 at least partially overlaps the convex strip 107.

Figure 31:
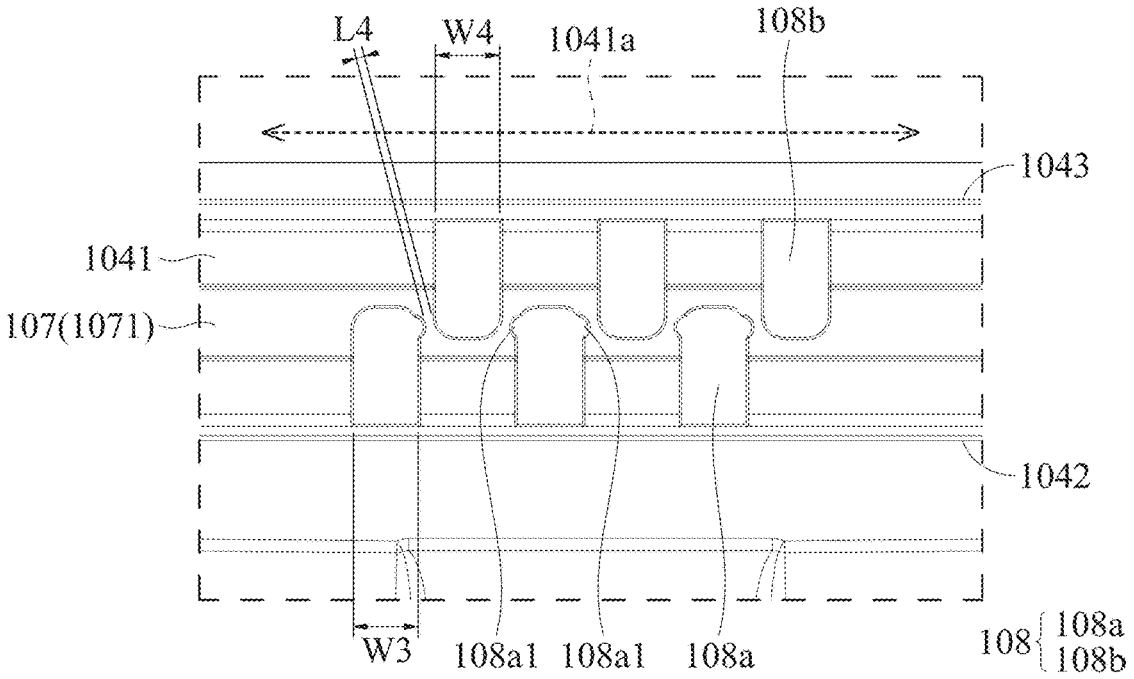
FIG. 31 illustrates an enlarged partial top view of the container in FIG. 29.

Next, refer to FIGS. 29, 30 and 31. FIG. 31 illustrates an enlarged partial top view of the container 1 in FIG. 29. The difference from the embodiment in FIG. 26 is that the groove 108 of the embodiment shown in FIGS. 29, 30 and 31 includes a first groove 108*a* and a second groove 108*b*, where the first groove 108*a* contacts the inner edge 1042 but does not contact the outer edge 1043, and the second groove 108*b* contacts the outer edge 1043 but does not contact the inner edge 1042. In some embodiments, as shown in FIG. 31, the first groove 108*a* extends from the inner edge 1042 to the convex strip 107, and the second groove 108*b* extends from the outer edge 1043 to the convex strip 107. Moreover, in this embodiment, an extension direction of the first groove 108*a* and an extension direction of the second groove 108*b* are perpendicular to the extension direction 1041*a* of the peripheral plane 1041.

In this embodiment, the first groove 108*a* and the second groove 108*b* only extend to the convex strip 107 and do not penetrate the convex strip 107, and are not in direct communication with the inner edge 1042 and the outer edge 1043. Accordingly, when the container 1 is subsequently sealed, the sealing film can still be attached to a portion of the convex strip 107 that does not overlap the first groove 108*a* and the second groove 108*b*. Therefore, even if the extension directions of the first groove 108*a* and the second groove 108*b* are perpendicular to the extension direction 1041*a* of the peripheral plane 1041, soup, and the like accommodated in the accommodation space 103 may not directly flow out through the first groove 108*a* or the second groove 108*b*. However, since the first groove 108*a* and the second groove 108*b* still reduce the area of the top surface 1071 of the convex strip 107, a pseudo-adhesive region may still be formed between the sealing film and the convex strip 107 for the steam in the accommodation space 103 to escape.

Still referring to FIG. 30 and FIG. 31, in some embodiments, the second groove 108*b* is between two adjacent first grooves 108*a*. With such arrangement, steam guided through the two first grooves 108*a* may pass through the pseudo-adhesive region formed between the convex strip 107 and the sealing film, and then be discharged through the adjacent second grooves 108*b*. In other words, based on the arrangement of "having a second groove 108*b* between two adjacent first grooves 108*a*", the two first grooves 108*a* and the second groove 108*b* may form channels for guiding steam to flow outside the container 1. It is to be noted that, the "two adjacent first grooves 108*a*" means that there is no other first grooves 108*a* between the two first grooves 108*a*.

Still referring to FIG. 30 and FIG. 31, in some embodiments, the first groove 108*a* is between two adjacent second grooves 108*b*. With such arrangement, steam guided through the first groove 108*a* may be dispersed to the two adjacent second grooves 108*b* through the pseudo-adhesive region formed between the convex strip 107 and the sealing film, and then be discharged through the two second grooves 108*b*. Similarly, the "two adjacent second grooves 108*b*" means that there is no other second grooves 108*b* between the two second grooves 108*b*.

Still referring to FIG. 31, in some embodiments, a width W3 of the first groove 108*a* is the same as a width W4 of the second groove, but is not limited thereto. Moreover, in some embodiments, a shortest distance L4 between the first groove 108*a* and the second groove 108*b* is smaller than the width W3 of the first groove 108*a*. By making the shortest distance L4 between the first groove 108*a* and the second groove 108*b* smaller than the width W3 of the first groove 108*a*, it may be further ensured that an amount of steam guided through the first groove 108*a* can push the pseudo-adhesive region formed between the sealing film and the convex strip 107 and then enter the second groove 108*b*.

Still referring to FIG. 31, in some embodiments, a portion where the first groove 108*a* overlaps the convex strip 107 has a protruding portion 108*a*1, and the protruding portion 108*a*1 extends toward the second groove 108*b*. By arranging the protruding portion 108*a*1, the shortest distance L4 between the first groove 108*a* and the second groove 108*b* may be further reduced. In some embodiments, as shown in FIG. 31, protruding portions 108*a*1 may be arranged on both sides of the first groove 108*a* between the two adjacent second grooves 108*b*.

Figure 25:
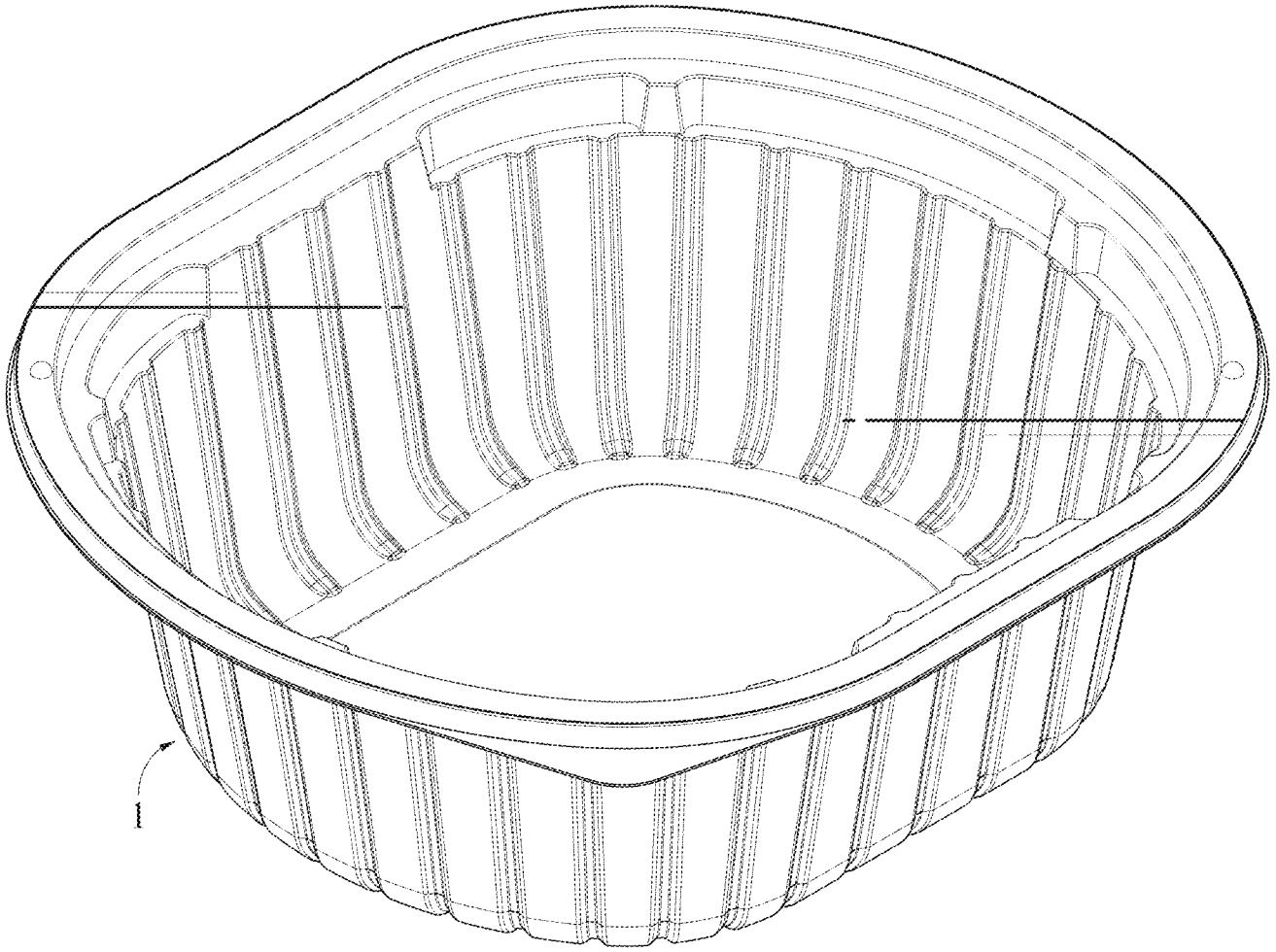
FIG. 25 illustrates a perspective view of a container with a sealing film attaching thereon according to an embodiment of the present application.

In summary, the present application provides a container 1 which still has a pressure relief function under the sealed state, and also provides a box having the container 1 with a sealing film attaching on it (for example, as shown in FIG. 25). More specifically, in the embodiments of group 1, the container 1 has a pressure relief protrusion 105 protruding outward from the peripheral plane 1041, and the pressure relief protrusion 105 has a pressure relief curved surface 1051 configured to contact the sealing film. Since, comparing to the attachment between the sealing film and the peripheral plane (which is flat), the attachment between the sealing film and the curved surface is relatively poorer. Thus, when the container 1 is attached with the sealing film and the accommodation space 103 is closed, a pseudo-adhesive region of the sealing film will be formed on the pressure relief protrusion 105 and/or around the pressure relief protrusion 105.

In the embodiments of group 2, the container 1 has the convex strip 107 on the peripheral plane 1041, which can reduce the adhesion effect between the sealing film and the peripheral plane 1041. Moreover, since the peripheral portion 104 has a groove 108 that overlaps the convex strip 107, the groove 108 further reduces the area of the top surface 1071 of the convex strip 107, so that the groove 108 may further reduce the adhesion effect between the sealing film and the convex strip 107. Thus, a pseudo-adhesive region is formed in a region provided with the groove 108 on the convex strip 107.

Accordingly, when the pressure increases inside the sealed container 1 due to the generation of steam in the accommodation space 103 from heating, the steam can be more easily discharged through the pseudo-adhesive region, thereby achieving the object that the container 1 has a pressure relief function even when it is under the sealed state with the sealing film.

Although the technical content of the present application has been disclosed as above with preferred embodiments, they are not intended to limit the invention. Any modifications made by those skilled in the art without departing from the spirit of the invention should be included within the scope of the invention. Therefore, the scope of protection of the invention should be defined by the claim below.

What is claimed is:

1. A container for food to be heated, comprising:

a bottom surface;

a side wall connected to the bottom surface, wherein the side wall and the bottom surface together form an accommodation space in communication with outside of the container;

a peripheral portion connected to the side wall and surrounding the accommodation space, wherein the peripheral portion has a peripheral plane, an inner edge, and an outer edge; the inner edge and the outer edge are borderlines of the peripheral portion and are respectively connected to the peripheral plane, the inner edge is on a side of the peripheral plane nearer the accommodation space, and the outer edge is on a side of the peripheral plane farther from the accommodation space;

a convex strip, protruding from the peripheral plane, wherein an extension direction of the convex strip is parallel to an extension direction of the peripheral plane, the convex strip has a top surface, the top surface being parallel to the peripheral plane; and a groove on the peripheral plane, wherein the groove is in contact with the inner edge or the outer edge, and the groove at least partially overlaps the convex strip, so that the groove, the peripheral plane, and the top surface of the convex strip form a stepped structure, wherein when a sealing film is attached to the stepped structure to enclose the accommodation space, the sealing film covers the top surface and is attached to a portion of the peripheral plane.

2. The container according to claim 1, wherein the groove extends from the inner edge to the outer edge, and an extension direction of the groove is not perpendicular to the extension direction of the peripheral plane.

3. The container according to claim 2, wherein the groove comprises a first groove and a second groove, an extension direction of the first groove being not parallel to an extension direction of the second groove.

4. The container according to claim 3, wherein the first groove intersects the second groove to form an intersection point, the intersection point being located on the convex strip.

5. The container according to claim 3, wherein the groove comprises two first grooves and two second grooves, each of the two first grooves intersecting the two second grooves to form two intersection points.

6. The container according to claim 5, wherein one of the two intersection points is located on the convex strip.

7. The container according to claim 6, wherein the convex strip has a recess therein, the recess being located between the two first grooves and the two second grooves.

8. The container according to claim 1, wherein the groove comprises:

a first groove, the first groove in contact with the inner edge but not in contact with the outer edge; and a second groove, the second groove in contact with the outer edge but not in contact with the inner edge.

9. The container according to claim 8, wherein the first groove extends from the inner edge to the convex strip, and the second groove extends from the outer edge to the convex strip.

10. The container according to claim 9, wherein an extension direction of the first groove and an extension direction of the second groove are perpendicular to the extension direction of the peripheral plane.

11. The container according to claim 10, wherein the groove comprises two first grooves, the second groove being located between the two first grooves.

12. The container according to claim 10, wherein the groove comprises two second grooves, the first groove being located between the two second grooves.

13. The container according to claim 9, wherein a shortest distance between the first groove and the second groove is less than a width of the first groove.

14. The container according to claim 13, wherein a portion where the first groove overlaps the convex strip has a protruding portion, the protruding portion extending toward the second groove.

15. A box, comprising: the container according to claim 1; and a sealing film, wherein the sealing film is attached to the peripheral plane; and the sealing film is attached to the top surface of the convex strip.

* * * * *